US010061226B2

(12) United States Patent
Kamihara et al.

(10) Patent No.: US 10,061,226 B2
(45) Date of Patent: Aug. 28, 2018

(54) IMAGE FORMING APPARATUS AND IMAGE FORMING METHOD

(71) Applicants: Kazuaki Kamihara, Tokyo (JP); Yuuichiroh Uematsu, Kanagawa (JP); Tetsuya Muto, Tokyo (JP); Tomohide Takenaka, Kanagawa (JP); Keita Sone, Tokyo (JP); Keita Gotoh, Kanagawa (JP); Masahiko Shakuto, Kanagawa (JP); Takamasa Ozeki, Kanagawa (JP); Mutsuki Morinaga, Kanagawa (JP); Hitoshi Yamamoto, Kanagawa (JP); Keiko Kajimura, Kanagawa (JP)

(72) Inventors: Kazuaki Kamihara, Tokyo (JP); Yuuichiroh Uematsu, Kanagawa (JP); Tetsuya Muto, Tokyo (JP); Tomohide Takenaka, Kanagawa (JP); Keita Sone, Tokyo (JP); Keita Gotoh, Kanagawa (JP); Masahiko Shakuto, Kanagawa (JP); Takamasa Ozeki, Kanagawa (JP); Mutsuki Morinaga, Kanagawa (JP); Hitoshi Yamamoto, Kanagawa (JP); Keiko Kajimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/477,576

(22) Filed: Apr. 3, 2017

(65) Prior Publication Data

US 2017/0315471 A1 Nov. 2, 2017

(30) Foreign Application Priority Data

Apr. 28, 2016 (JP) ..... 2016-091662
Jul. 29, 2016 (JP) ..... 2016-150775

(51) Int. Cl.
*G03G 15/00* (2006.01)
*G03G 15/08* (2006.01)

(52) U.S. Cl.
CPC ..... *G03G 15/0855* (2013.01); *G03G 15/0806* (2013.01); *G03G 15/0831* (2013.01); *G03G 15/0832* (2013.01); *G03G 15/5058* (2013.01)

(58) Field of Classification Search
CPC ..... G03G 15/0855; G03G 15/0832; G03G 15/0806; G03G 15/0831; G03G 15/5041; G03G 15/5058
(Continued)

(56) References Cited

U.S. PATENT DOCUMENTS

2012/0201552 A1 8/2012 Hirai et al.
2013/0108288 A1 5/2013 Kaneko et al.
(Continued)

FOREIGN PATENT DOCUMENTS

JP 2011-257497 12/2011
JP 2012-155112 8/2012
JP 2015-058561 3/2015

*Primary Examiner* — Sophia S Chen
(74) *Attorney, Agent, or Firm* — Oblon, McClelland, Maier & Neustadt, L.L.P.

(57) ABSTRACT

An image forming apparatus includes an image bearer, a toner image forming device, a plurality of image density detectors, and a controller. The plurality of image density detectors are disposed at predetermined intervals opposite the image bearer in a width direction of the image bearer. The controller causes the toner image forming device to form toner image patterns having an identical density at the plurality of positions on the image bearer and the plurality of image density detectors detects a density of the toner image patterns. Based on the detected density of the toner image patterns, the controller identifies multiple cyclic fluctuations of the density of the toner image patterns and adjusts an image forming condition based on the multiple
(Continued)

cyclic fluctuations of the density of the toner image patterns to decrease an amplitude caused by the multiple cyclic fluctuations of the density of the toner image patterns.

23 Claims, 11 Drawing Sheets

(58) Field of Classification Search
USPC ..... 399/49, 72
See application file for complete search history.

(56) References Cited

U.S. PATENT DOCUMENTS

2013/0108292 A1 5/2013 Suzuki et al.
2013/0243456 A1 9/2013 Kaneko et al.
2013/0243457 A1 9/2013 Kaneko et al.
2013/0302049 A1* 11/2013 Nakagawa ..... G03G 15/5058 399/49
2014/0169814 A1 6/2014 Uematsu et al.
2014/0270827 A1 9/2014 Muto et al.
2014/0270828 A1 9/2014 Suzuki et al.
2014/0301748 A1 10/2014 Suzuki et al.
2015/0063844 A1* 3/2015 Masuda ..... G03G 15/2017 399/33
2015/0261162 A1 9/2015 Kaneko et al.
2015/0316885 A1 11/2015 Uematsu et al.
2015/0362879 A1 12/2015 Kaneko et al.
2016/0018774 A1* 1/2016 Abe ..... G03G 15/5058 399/72
2016/0062260 A1 3/2016 Kaneko et al.
2016/0112580 A1 4/2016 Muto et al.
2016/0124367 A1 5/2016 Kaneko et al.
2016/0187807 A1 6/2016 Hirai et al.
2016/0299452 A1 10/2016 Kaneko et al.
2016/0334734 A1 11/2016 Kaneko et al.

* cited by examiner

IMAGE FORMING APPARATUS AND IMAGE FORMING METHOD

CROSS-REFERENCE TO RELATED APPLICATIONS

This patent application is based on and claims priority pursuant to 35 U.S.C. § 119 to Japanese Patent Application Nos. 2016-091662, filed on Apr. 28, 2016, and 2016-150775, filed on Jul. 29, 2016, in the Japanese Patent Office, the entire disclosure of each of which is hereby incorporated by reference herein.

BACKGROUND

Technical Field

Illustrative embodiments generally relate to an image forming apparatus and an image forming method.

Background Art

In image forming apparatuses such as copiers, facsimile machines, printers, and multifunction peripherals, image density of a formed image may fluctuate due to various factors. For example, the image density fluctuates due to change in a rotation cycle of a developer bearer. Such cyclic fluctuation of the image density may be suppressed by optically detecting a toner image pattern on an image bearer and adjusting an image forming condition, such as a developing bias, according to a result of detection of the toner image pattern.

SUMMARY

This specification describes below an improved image forming apparatus. In one illustrative embodiment, the image forming apparatus includes an image bearer to rotate in a predetermined direction of rotation, a toner image forming device to form a plurality of toner image patterns on the image bearer, a plurality of image density detectors, and a controller. The plurality of image density detectors detect a density of the toner image patterns formed on the image bearer, and are disposed opposite a plurality of positions, respectively, on the image bearer in a width direction perpendicular to the direction of rotation of the image bearer. The controller determines an image forming condition used to form a toner image having a predetermined target density based on the detected density of the toner image patterns. The controller causes the toner image forming device to form the toner image patterns having an identical density at the plurality of positions on the image bearer, respectively. And the controller identifies multiple cyclic fluctuations of the density of the toner image patterns, determines the image forming condition based on the multiple cyclic fluctuations of the density of the toner image patterns to decrease an amplitude caused by the multiple cyclic fluctuations of the density of the toner image patterns.

This specification further describes an improved image forming method. In one illustrative embodiment, the image forming method includes forming a plurality of toner image patterns on a plurality of positions on an image bearer, detecting a density of each of the toner image patterns, detecting a rotational position of a latent image bearer, calculating an amplitude and a phase of a fluctuation of a toner adhesion amount of each of the toner image patterns, determining an optimum amplitude and an optimum phase used to correct an image forming condition based on the calculated amplitude and the calculated phase, respectively and producing a control table for controlling a developing bias and a charging bias based on the calculated optimum amplitude and the calculated optimum phase.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
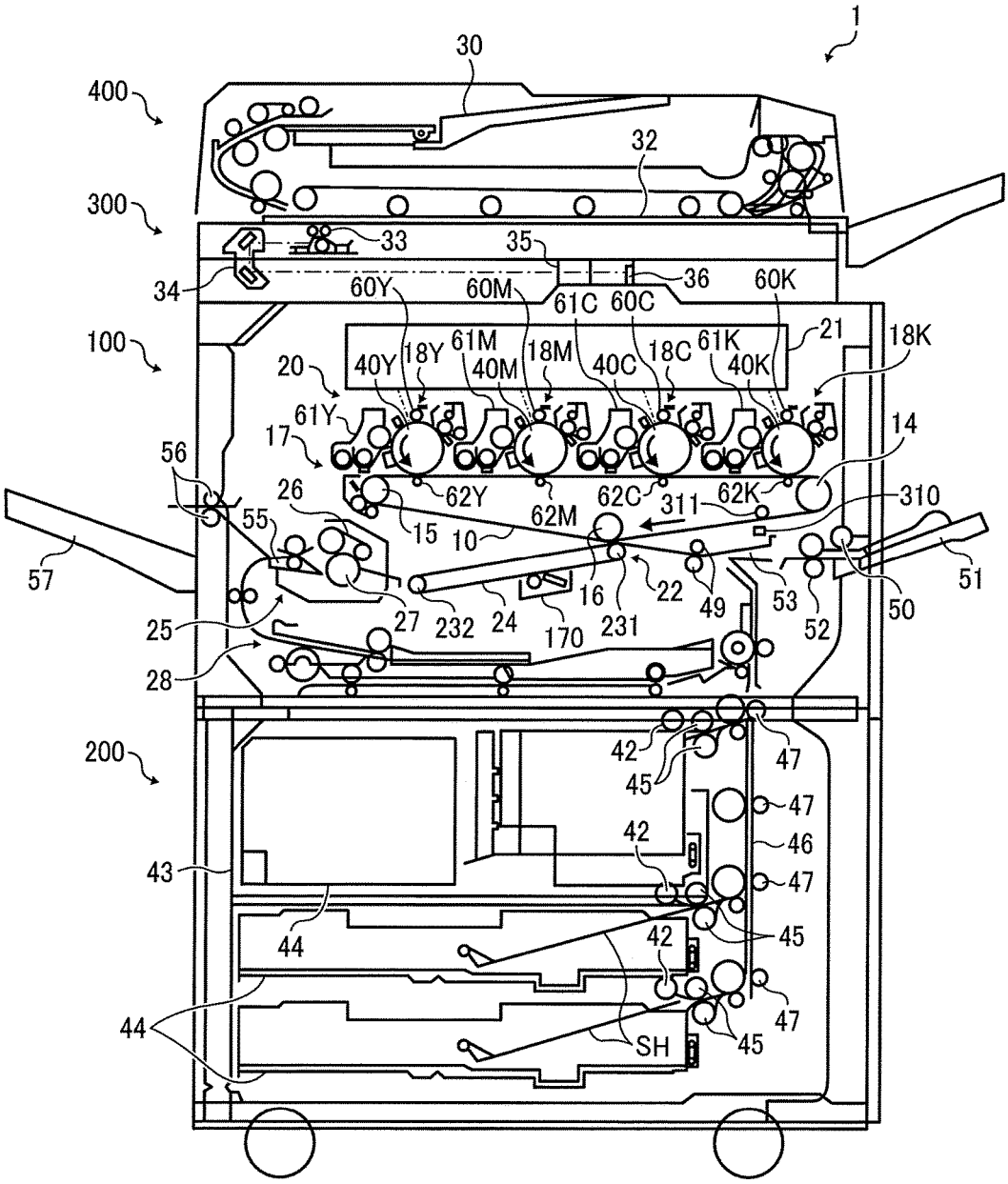
FIG. 1 is a schematic diagram of an image forming apparatus according to an illustrative embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an illustrative embodiment is described.

Hereinafter, an embodiment is described below with reference to drawings. FIG. 1 is a schematic diagram of the image forming apparatus 1 according to this illustrative embodiment. Referring to FIG. 1, the image forming apparatus 1 according to the present embodiment includes a body (that is, a printing section) 100, a paper feed table 200 that feeds a recording medium, and a scanner 300 serving as an image reader. The body 100 is mounted on the paper feed table 200. The scanner 300 is mounted on the body 100. The image forming apparatus 1 according to this illustrative embodiment further includes an automatic document feeder (ADF) 400 mounted on the scanner 300.

The body 100 includes an intermediate transfer belt 10 that is an endless belt serving as an image bearer or an intermediate transfer body disposed in a center of the body 100. The intermediate transfer belt 10 is stretched over a first support roller 14, a second support roller 15 and a third support roller 16 serving as three supporting rotary bodies and rotates clockwise in FIG. 1. An intermediate transfer belt cleaner 17 is disposed on the left of the second support roller 15 of the three supporting rotary bodies in FIG. 1. The intermediate transfer belt cleaner 17 removes residual toner on the intermediate transfer belt 10 after image transfer. In addition, a tandem image forming unit 20 serving as a toner image forming device is disposed opposite a surface portion of the intermediate transfer belt 10 stretched taut across the first support roller 14 and second support roller 15 of the three supporting rotary bodies.

The tandem image forming unit 20 includes four image forming units 18Y, 18M, 18C, and 18K corresponding to colors of yellow, magenta, cyan, and black respectively, and being disposed along a rotation direction of the intermediate transfer belt 10 as illustrated in FIG. 1. According to this illustrative embodiment, the third support roller 16 is a driving roller. An exposure unit 21 serving as an exposure means is provided above the tandem image forming unit 20.

A secondary transfer device 22 serving as a secondary transfer means is disposed opposite the tandem image forming unit 20 with the intermediate transfer belt 10 in between. In the secondary transfer device 22, a secondary transfer belt 24 being an endless belt is stretched across two rollers 231 and 232 and serves to convey a recording medium. The secondary transfer belt 24 presses against the third support roller 16 via the intermediate transfer belt 10. A toner image formed on the intermediate transfer belt 10 is transferred to a sheet SH serving as a recording medium by the secondary transfer device 22. Optionally, a secondary transfer belt cleaning device 170 may be provided to clean an outer circumferential surface of the secondary transfer belt 24 as illustrated in FIG. 1.

A fixing device 25 that fixes the toner image transferred on a sheet SH is provided on the left of the secondary transfer device 22 in FIG. 1. The fixing device 25 includes a fixing belt 26 serving as an endless belt to be heated and a pressure roller 27 pressed against the fixing belt 26. The secondary transfer device 22 includes a function to convey the sheet SH on which the toner image has been transferred from the intermediate transfer belt 10 to the fixing device 25.

Further, a sheet reverse unit 28 to reverse the sheet SH to print on both sides of the sheet SH is disposed in parallel to the tandem image forming unit 20 and below the secondary transfer device 22 and the fixing device 25.

When a copy is created using the image forming apparatus 1 configured as described above, a user places an original on an original tray 30 of the ADF 400. Alternatively, the user may place the original on an exposure glass 32 of the scanner 300 after lifting the ADF 400 and may press the original against the exposure glass 32 by lowering the ADF 400. Thereafter, as the user presses a start key on a control panel, the ADF 400 conveys the original placed on the ADF 400 onto the exposure glass 32.

On the other hand, when the original is placed on the exposure glass 32, as the user presses the start key, the scanner 300 is driven immediately to move a first carriage 33 and a second carriage 34. Subsequently, the first carriage 33 directs an optical beam from a light source onto the original and the optical beam is reflected from a surface of the original to the second carriage 34. Further, the optical beam reflected from a mirror of the second carriage 34 passes through an imaging forming lens 35 and enters an image reading sensor 36. Thus, the image reading sensor 36 reads an image on the original to obtain image data.

In parallel to the original reading, a drive motor serving as a driver drives and rotates the third support roller 16. Accordingly, when the intermediate transfer belt 10 rotates clockwise in FIG. 1, the other two supporting rotary bodies, that are the first support roller 14 and the second support roller 15 are driven in accordance with the rotation of the intermediate transfer belt 10.

The image forming units 18Y, 18M, 18C, and 18K include drum-shaped photoconductors 40Y, 40M, 40C, and 40K serving as rotatable latent image bearers, respectively. In parallel with the original reading and the rotation of the intermediate transfer belt 10 described above, the drum-shaped photoconductors 40Y, 40M, 40C, and 40K rotate. The drum-shaped photoconductors 40Y, 40M, 40C, and 40K are referred to as photoconductors 40Y, 40M, 40C, and 40K, respectively. A surface of each of the photoconductors 40Y, 40M, 40C, and 40K is exposed according to the image data of respective colors of yellow, magenta, cyan, and black to form electrostatic latent images. The electrostatic latent images are developed into yellow, magenta, cyan, and black toner images as visible toner images, respectively.

Primary transfer devices 62Y, 62M, 62C, and 62K serving as primary transfer means including primary transfer rollers are disposed opposite the photoconductors 40Y, 40M, 40C, and 40K, respectively, via a belt part of the intermediate transfer belt 10, which is between the first support roller 14 and the second support roller 15. The primary transfer devices 62Y, 62M, 62C, and 62K are sequentially transfer the toner images on the photoconductors 40Y, 40M, 40C, and 40K, respectively, onto the intermediate transfer belt 10 such that the toner images are superimposed on a same position on the intermediate transfer belt 10, thus forming a composite color toner image on the intermediate transfer belt 10.

In parallel to the above image formation, one of feed rollers 42 of the paper feed table 200 is selectively rotated, so that the sheet SH is fed from one of several multistage paper trays 44 mounted in a paper bank 43. The fed sheets SH are separated one by one by a separation roller pair 45. The separated sheet SH is inserted into a sheet conveyance path 46, is conveyed by a conveyance roller 47 and introduced into a sheet conveyance path inside the body 100, and is stopped by a registration roller pair 49 when the sheet SH contacts the registration roller pair 49. Otherwise, a sheet feed roller 50 is rotated to feed sheets SH on a bypass tray 51 and the fed sheets SH are separated one by one by a separation roller pair 52. The separated sheet SH is introduced into a bypass sheet conveyance path 53 and is stopped by the registration roller pair 49 similarly.

Subsequently, the registration roller pair 49 resumes rotation to send the sheet SH to a secondary transfer nip formed between the intermediate transfer belt 10 and the secondary transfer device 22 at an appropriate time, that is, when the composite color toner image formed on the intermediate transfer belt 10 reaches the secondary transfer nip. Accordingly, the composite color toner image is transferred onto the sheet SH at the secondary transfer nip.

The secondary transfer belt 24 conveys the sheet SH bearing the color toner image to the fixing device 25 that fixes the color toner image on the sheet SH under heat and pressure applied by the fixing belt 26 and the pressure roller 27. After the above fixing process, a switching pawl 55 directs the sheet SH to an ejection roller pair 56. The ejection roller pair 56 ejects the sheet SH onto a sheet ejection tray 57 that stacks the sheet SH. Alternatively, the switching pawl 55 directs the sheet SH to the sheet reverse unit 28 that reverse the sheet SH and guides the sheet SH to the secondary transfer nip where another toner image is transferred onto a back side of the sheet SH. Thereafter, the ejection roller pair 56 ejects the sheet SH onto the sheet ejection tray 57.

The intermediate transfer belt cleaner 17 cleans the intermediate transfer belt 10 after the toner image transfer. Specifically, the intermediate transfer belt cleaner 17 removes residual toner remaining on the intermediate transfer belt 10 after the toner image transfer. Thus, the tandem image forming unit 20 becomes ready for the next image formation. The registration roller pair 49 is generally grounded; however, the registration roller pair 49 may be applied with bias voltage to remove paper dust from the sheet SH.

The body 100 includes a toner adhesion amount sensor 310 as an optical sensor unit serving as an image density detector to detect a density of the toner image formed on an outer circumferential surface of the intermediate transfer belt 10. The toner adhesion amount sensor 310 works as an image density detector that detects image density fluctuations by detecting the toner adhesion amount on the intermediate transfer belt 10. The toner adhesion amount sensor 310 is also called a toner image detection sensor. The toner adhesion amount sensor 310 detects a density of the toner image of an image pattern formed on the surface of the intermediate transfer belt 10, of which the detection result is used in correction control of the image density fluctuation. Additionally, an optical sensor-opposite roller 311 may be disposed at a position opposite the toner adhesion amount sensor 310 with the intermediate transfer belt 10 sandwiched in-between.

Figure 2:
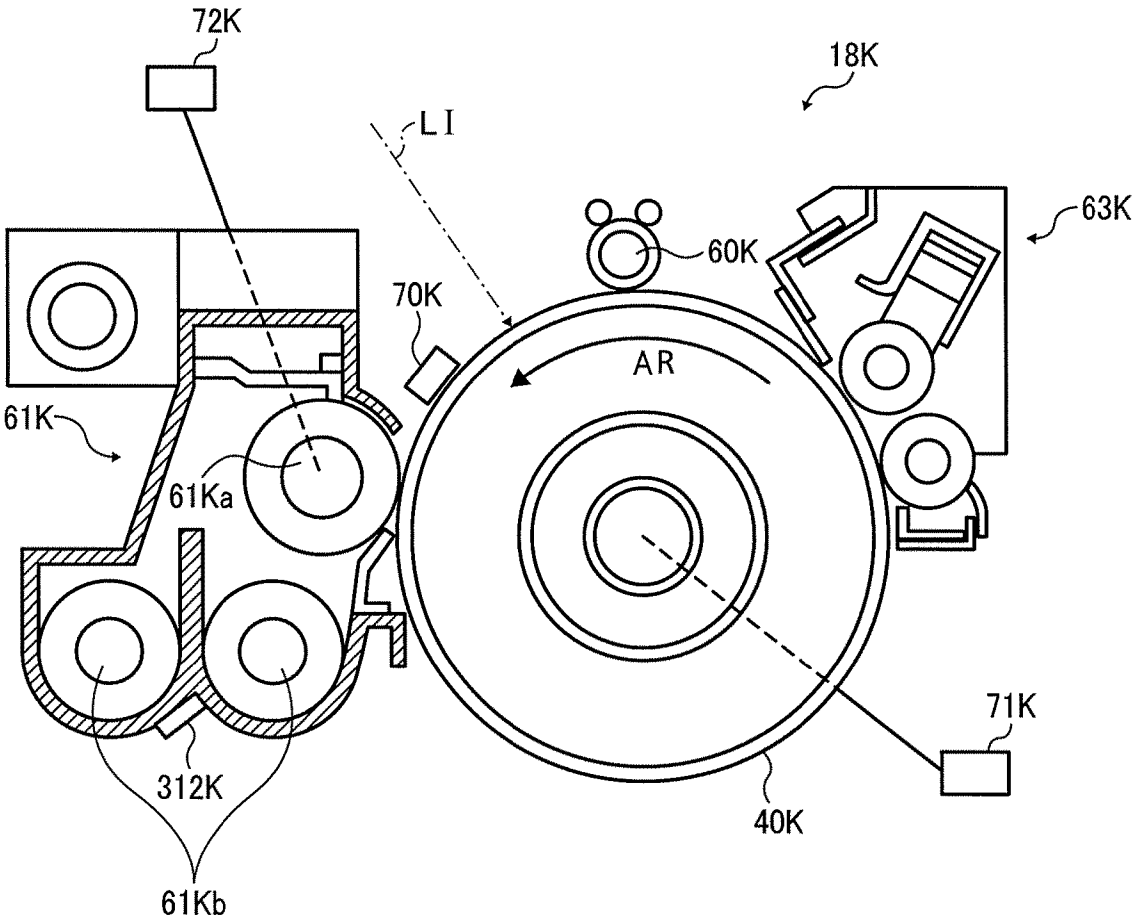
FIG. 2 is an explanatory view of one of image forming units incorporated in the image forming apparatus illustrated in FIG. 1.

FIG. 2 is an explanatory view of the image forming unit 18K as one of the image forming units 18Y, 18M, 18C, and 18K of the image forming apparatus 1 according to the illustrative embodiment of the present disclosure. The image forming unit 18K for forming the black toner image is described here. However, the image forming units 18Y, 18M, and 18C have an identical configuration.

The image forming unit 18K includes a charging device 60K serving as a charger, a potential sensor 70K, a developing device 61K serving as a developing means, a photoconductor cleaner 63K, and a discharger, which are around the photoconductor 40K as illustrated in FIG. 2.

The photoconductor 40K is driven by a drive motor, serving as an image bearer driver, to rotate in a rotation direction AR during image formation. The surface of the photoconductor 40K is uniformly charged by the charging device 60K and is exposed by exposure light LI from the exposure unit 21 controlled based on color image signals generated according to the image data created by the scanner 300 that reads the image on the original. Thus, an electrostatic latent image is formed on the surface of the photoconductor 40K. The color image signals generated according to the image data from the scanner 300 are subjected to imaging processes such as a color conversion process by an image processor and output to the exposure unit 21 as image signals for each color of yellow, magenta, cyan, and black.

The exposure unit 21 converts black image signals from the image processor into optical signals and irradiates and scans the uniformly-charged surface of the photoconductor 40K with the exposure light LI based on the optical signals. Thus, an electrostatic latent image is formed on the photoconductor 40K.

The developing device 61K includes a developing roller 61Ka serving as a developer bearer that is applied with a developing bias voltage. Thus, a developing potential is formed between the electrostatic latent image on the photoconductor 40K and the developing roller 61Ka. Due to the developing potential, the toner on the developing roller 61Ka moves from the developing roller 61Ka to the electrostatic latent image on the photoconductor 40K, that is, the electrostatic latent image is developed into a toner image. A toner density sensor 312K to detect toner density in a developer is disposed at a bottom of one of developer conveyance portions that are provided with conveyance screws 61Kb, respectively, in the developing device 61K.

The primary transfer device 62K depicted in FIG. 1 primarily transfers the black toner image from the photoconductor 40K onto the intermediate transfer belt 10. The photoconductor cleaner 63K removes the residual toner from the surface of the photoconductor 40K after the toner image transfer. The discharger discharges the surface of the photoconductor 40K. Thus, the photoconductor 40K is ready for the next image formation. Similarly, the image forming units 18Y, 18M, and 18C include charging devices, potential sensors, developing devices, photoconductor cleaners, and dischargers, which are around the photoconductor 40Y, 40M, and 40C, respectively. The image forming units 18Y, 18M, and 18C form yellow, magenta, and cyan toner images on the photoconductors 40Y, 40M, and 40C, respectively. The toner images are primarily transferred onto the intermediate transfer belt 10 such that the yellow, magenta, and cyan toner images are superimposed on the intermediate transfer belt 10.

The exposure unit 21 and the charging devices 60Y, 60M, 60C, and 60K in the image forming apparatus 1 described above work as electrostatic latent image writers that form electrostatic latent images on the surface of the respective photoconductors 40Y, 40M, 40C, and 40K. The exposure unit 21, the charging devices 60Y, 60M, 60C, and 60K, and the developing devices 61Y, 61M, 61C, and 61K work as toner image forming means that form toner images on the surface of the respective photoconductors 40Y, 40M, 40C, and 40K.

The image forming apparatus 1 according to the illustrative embodiment includes a photointerrupter 71K and a photointerrupter 72K. The photointerrupter 71K is a rotational position detector that detects a rotational position of the photoconductor 40K. The photointerrupter 72K is a rotational position detector that detects a rotational position of the developing roller 61Ka. The photointerrupter 71K and the photointerrupter 72K optically detect the rotational position of the photoconductor 40K serving as one rotating body and the developing roller 61Ka serving as another rotating body, respectively. For example, each of the photointerrupter 71K and the photointerrupter 72K includes a light-emitting element and a light-receiving element disposed opposite each other. A feeler for detecting rotational position is disposed on a rotating part of the rotating body. When the feeler passes through a space between the light-emitting element and the light-receiving element, light from the light-emitting element is cut out by the feeler. Thus, a rotational position of the rotating body is identified. For example, the feeler for detecting rotational position rotates together with the photoconductor 40K. The feeler includes a notch around a circumference of the feeler. Therefore, light passes through the notch and reaches the light-receiving element with every turn of the photoconductor 40K. Thus, the rotational position of the photoconductor 40K is identified. The rotational position detector that detects a rotational position of the rotating body such as the photoconductor 40K and the developing roller 61Ka may use devices other than a photointerrupter.

Figure 3A:
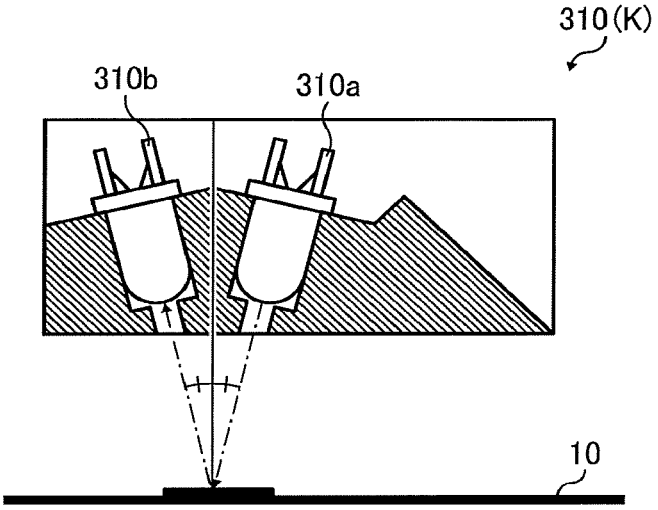
FIG. 3A is an explanatory view of a toner adhesion amount sensor for detecting a black toner image, that is incorporated in the image forming apparatus illustrated in FIG. 1.
Figure 3B:
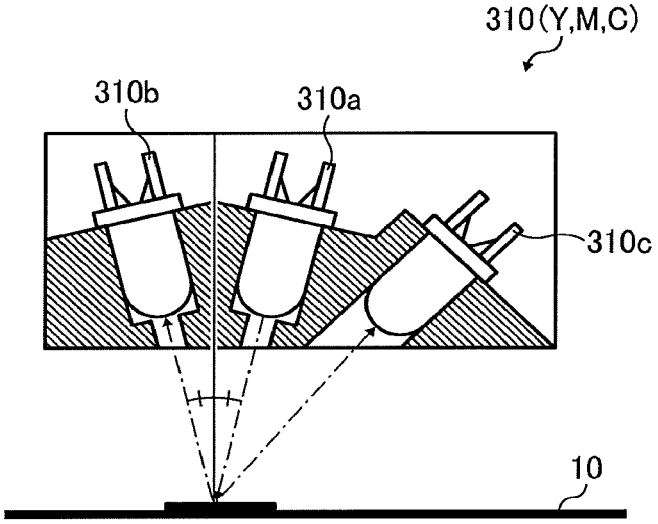
FIG. 3B is an explanatory view of a toner adhesion amount sensor for detecting a yellow toner image, a magenta toner image, or a cyan toner image, that is incorporated in the image forming apparatus illustrated in FIG. 1.

FIGS. 3A and 3B illustrate an explanatory view of the toner adhesion amount sensor 310 as an image density detector to detect a density of the toner image patterns in the image forming apparatus 1 according to the illustrative embodiment of the present disclosure. The toner adhesion amount sensor 310 includes a black toner adhesion amount sensor 310(K) and a color toner adhesion amount sensor 310(Y, M, C). FIG. 3A illustrates a configuration of the black toner adhesion amount sensor 310K suitable for detecting the density of the black toner image. FIG. 3B illustrates a configuration of the color toner adhesion amount sensors 310Y, 310M, and 310C suitable for detecting the density of the color toner images, that is, the yellow, magenta, and cyan toner images.

As illustrated in FIG. 3A, the black toner adhesion amount sensor 310 K includes a light-emitting element 310*a* such as a light emitting diode (LED) and a light-receiving element 310*b* to receive specular reflection light. The light-emitting element 310*a* irradiates the intermediate transfer belt 10 with light that is reflected by the intermediate transfer belt 10. The light-receiving element 310*b* receives the specular reflection light among the reflection light.

As illustrated in FIG. 3B, each of the color toner adhesion amount sensor 310 (Y, M, C) includes the light-emitting element 310*a* that includes the LED, the light-receiving element 310*b* to receive the specular reflection light, and a light-receiving element 310*c* to receive diffused reflection light. The light-emitting element 310*a* of the color toner adhesion amount sensor 310(Y, M, C) irradiates the intermediate transfer belt 10 with light like the black toner adhesion amount sensor 310K. The irradiation light is reflected by the surface of the intermediate transfer belt 10. The light-receiving element 310*b* receives the specular reflection light among the reflection light. The light-receiving element 310*c* receives the diffused reflection light among the reflection light.

According to the illustrative embodiment, the light-emitting elements 310*a* employs a gallium arsenide (GaAs) infrared light emitting diode having a peak wavelength of 950 nm of the emitting light. Each of the light-receiving elements 310*b* and 310*c* employs a silicon (Si) photo transistor having a peak light receiving sensitivity of 800 nm. However, the peak wavelength and the peak light receiving sensitivity may be different from the above values. For example, a gap of about 5 mm is provided between the black toner adhesion amount sensor 310K or the color toner adhesion amount sensor 310(Y,M,C) and the intermediate transfer belt 10 transferred with a toner image as a detection target.

According to the illustrative embodiment, the toner adhesion amount sensor 310 is disposed in proximity to the intermediate transfer belt 10. Predetermined toner image patterns are formed on the photoconductors 40Y, 40M, 40C, and 40K and transferred to the intermediate transfer belt 10, respectively. The toner adhesion amount sensor 310 detects the density of the toner image patterns. An image formation condition is then determined based on the detected results of toner image density, that is, toner adhesion amount of the toner image patterns formed on the intermediate transfer belt 10.

According to this illustrative embodiment, the toner adhesion amount sensor 310 is disposed in the vicinity of the intermediate transfer belt 10. Alternatively, the toner adhesion amount sensor 310 may be disposed in the vicinity of each of the photoconductors 40Y, 40M, 40C, and 40K or a conveyance belt conveying a sheet SH. The toner image density may be detected on the toner image patterns formed on the photoconductors 40Y, 40M, 40C, and 40K directly or transferred from each of the photoconductors 40Y, 40M, 40C, and 40K to the conveyance belt.

According to the this illustrative embodiment of the image forming apparatus 1, multiple toner adhesion amount sensors 310 are aligned in a width direction of the intermediate transfer belt 10 as described below with reference to FIG. 6. Outputs from the black toner adhesion amount sensors 310K and from the color toner adhesion amount sensors 310(Y, M, C) are converted to toner adhesion amounts by an adhesion amount conversion algorithm. Known algorithms are usable for the adhesion amount conversion algorithm to convert the toner adhesion amount. Therefore, outputs from the toner adhesion amount sensors 310 correspond to toner adhesion amounts of the toner image patterns detected by the toner adhesion amount sensors 310. The toner adhesion amount corresponds to the toner image density of the toner image pattern. The toner adhesion amount sensors 310 thus work as image density detectors.

Figure 4:
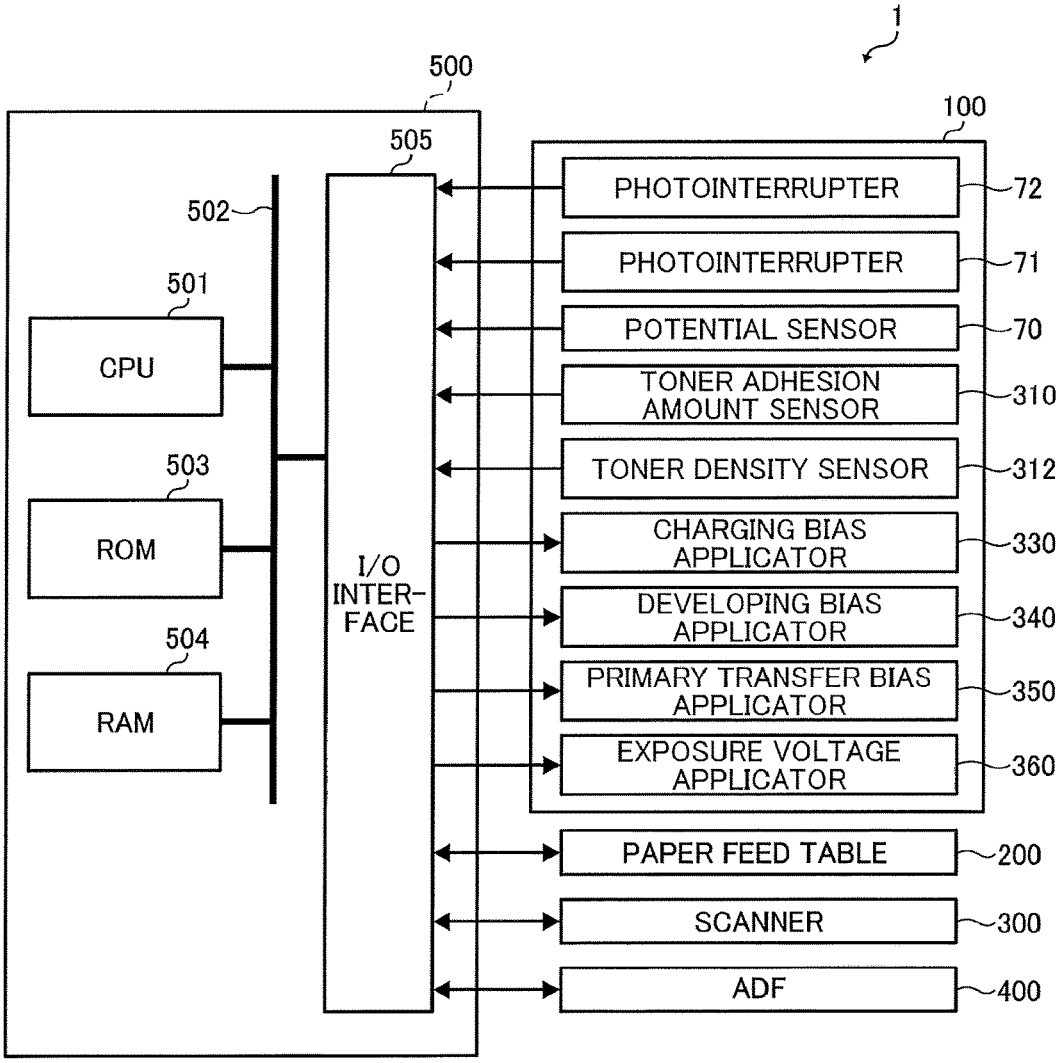
FIG. 4 is a block diagram of the image forming apparatus illustrated in FIG. 1, illustrating a controller incorporated in the image forming apparatus.

FIG. 4 is a block diagram illustrating an example configuration of a control system of the image forming apparatus 1 depicted in FIG. 1. The image forming apparatus 1 includes a controller 500 including a computer such as a microcomputer. The controller 500 controls the image forming units 18Y, 18M, 18C, and 18K according to input image data and serves as an image quality adjusting means to adjust the quality of an output image. An image quality adjustment control according to this illustrative embodiment includes at least an image forming condition determination process to determine the image forming condition to reduce a periodical image density fluctuation occurring at a rotary cycle of each rotating body including the photoconductors 40Y, 40M, 40C, and 40K and a developing roller represented by the developing roller 61Ka in FIG. 2 of the image forming units 18Y, 18M, 18C, and 18K.

The controller 500 includes a central processing unit (CPU) 501. The controller 500 further includes a read only memory (ROM) 503 as a memory means connected to the CPU 501 via a bus line 502, a random access memory RAM 504, and an input output (I/O) interface 505. The CPU 501 causes a control program, that is, a pre-installed computer program, to execute various computations and driving controls on each part and component. The ROM 503 previously stores fixed data such as a computer program or data for control. The RAM 504 serves as a work area to execute instructions and store various rewritable data.

Various sensors including the toner adhesion amount sensors 310, a toner density sensor 312, and a potential sensor 70 of the body 100 (e.g., a printer section) are connected to the controller 500 via the I/O interface 505. Information detected by the various sensors including the toner adhesion amount sensors 310, the toner density sensor 312, and the potential sensor 70 is sent to the controller 500. Further, a charging bias applicator 330 (e.g., a charging bias power supply) to apply a predetermined charging bias to the charging devices 60Y, 60M, 60C, and 60K (e.g., a charging roller) is connected to the controller 500 via the I/O interface 505. A developing bias applicator 340 (e.g., a developing bias power supply) to apply a predetermined developing bias to the developing roller of the developing devices 61Y, 61M, 61C, and 61K is also connected to the controller 500 via the I/O interface 505.

A primary transfer bias applicator 350 (e.g., a primary transfer bias power supply) to apply a predetermined primary transfer bias to the primary transfer rollers of the primary transfer devices 62Y, 62M, 62C, and 62K is connected to the controller 500 via the I/O interface 505. An exposure voltage applicator 360 (e.g., a light source power supply) to apply a predetermined voltage to the light source of the exposure unit 21 is connected to the controller 500 via the I/O interface 505. The paper feed table 200, the scanner 300, and the ADF 400 are connected to the controller 500 via the I/O interface 505. The controller 500 controls each part of the body 100 based on target control values for image forming conditions such as charging bias, developing bias, exposure light amount, and primary transfer bias.

The ROM 503 or the RAM 504 stores a conversion table storing information related to the conversion from output values of the toner adhesion amount sensors 310 to the toner adhesion amount per unit area. In addition, the ROM 503 or the RAM 504 stores target control values for image forming condition such as the charging bias, the developing bias, the exposure light amount, and the primary transfer bias of the image forming units 18Y, 18M, 18C, and 18K of the image forming apparatus 1.

Instead of a computer such as a microcomputer, the controller 500 may be an integrated circuit (IC) as a semiconductor circuit element.

Figure 5:
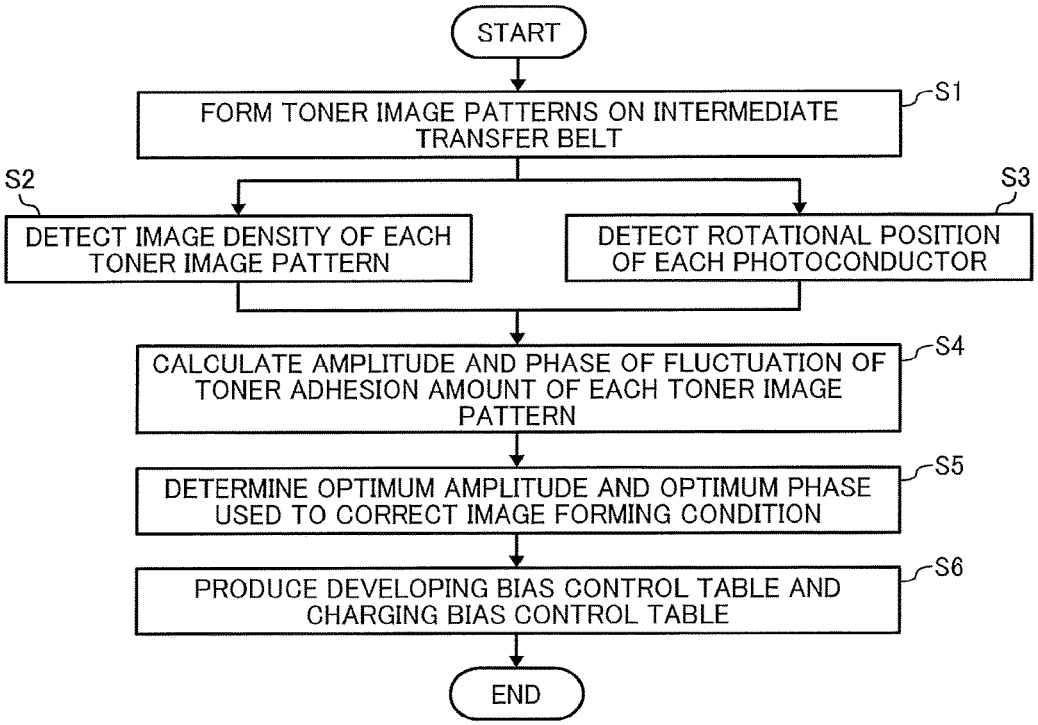
FIG. 5 is a flowchart of an image density correction control according to a first illustrative embodiment that is performed by the controller illustrated in FIG. 4.

A description is provided of a first illustrative embodiment of an image density correction control performed by the image forming apparatus 1 using FIG. 5.

FIG. 5 is a flowchart illustrating one example of the first illustrative embodiment of the image density correction control that corrects a cyclic fluctuation of an image density. The image forming apparatus 1 according to this illustrative embodiment has the multiple toner adhesion amount sensors 310 provided in a main scanning direction perpendicular to the rotational direction of the intermediate transfer belt 10 and corrects the cyclic fluctuation of image density based on the detected results of the multiple toner adhesion amount sensors 310.

Firstly, the image forming units 18Y, 18M, 18C, and 18K form multiple toner image patterns (e.g., solid toner image patterns) having a predetermined toner image density at multiple predetermined positions on the intermediate transfer belt 10 in the main scanning direction, respectively, in step S1, as described below with reference to FIG. 6. Positions of the toner image patterns in the main scanning direction are three points, a front part, a center part, a rear part of the intermediate transfer belt 10 in the main scanning direction. Multiple toner adhesion amount sensors 310F, 310C, and 310R are disposed opposite the front part, the center part, and the rear part of the intermediate transfer belt 10, respectively, where the toner adhesion amount sensors 310F, 310C, and 310R detect the toner image patterns. The multiple toner adhesion amount sensors 310F, 310C, and 310R detect image density (e.g., toner adhesion amount) of the toner image patterns on the intermediate transfer belt 10 in step S2. In parallel to the image density detection (e.g., toner adhesion amount detection) of the toner image patterns, photointerrupters represented by the photointerrupter 71K depicted in FIG. 2 detect a rotational position of the respective photoconductors 40Y, 40M, 40C, and 40K in step S3. As a result, fluctuating output signals corresponding to the three positions on the intermediate transfer belt 10 are obtained as illustrated in FIG. 7 described below. Each output signal corresponds to image density and toner adhesion amount. According to this illustrative embodiment, the three toner image patterns are formed and aligned in the main scanning direction. Alternatively, the number of the toner image patterns aligned in the main scanning direction are not limited to three. For example, four or more toner image patterns may be formed on the intermediate transfer belt 10.

Next, using rotational position signals detected by a photointerrupter 71 for each of the photoconductors 40Y, 40M, 40C, and 40K and toner adhesion amount signals (e.g., toner image density detection signals) detected by the multiple toner adhesion amount sensors 310F, 310C, and 310R, the controller 500 calculates a phase and an amplitude of each image density fluctuation about each position and each color. Specifically, the controller 500 calculates phase data and amplitude data of a fluctuation of an image density in a cycle Ts of one turn of each of the photoconductors 40Y, 40M, 40C, and 40K as described below with reference to FIGS. 7A, 7B, 7C, and 7D in step S4. For example, the controller 500 calculates an amplitude and a phase of a fluctuation of the toner adhesion amount of each of the toner image patterns. FIGS. 7A, 7B, 7C, and 7D illustrate an example about one of the photoconductors 40Y, 40M, 40C, and 40K. The controller 500 calculates the phase data and the amplitude data of the fluctuation of the image density based on each of the toner image patterns formed in the main scanning direction, that is, each of output signals from the multiple toner adhesion amount sensors 310F, 310C, and 310R as described below with reference to FIGS. 7A, 7B, and 7C.

In the next step, the controller 500 determines an optimum solution of phase data and amplitude data to be corrected in each color based on the phase data and the amplitude data of the fluctuation of the image density calculated from the output signals of each of the toner image patterns formed in the main scanning direction in step S5 as described below with reference to FIGS. 8A, 8B, 8C, 8D, 8E, and 8F.

Based on the determined phase data and the determined amplitude data to be corrected, control data of image forming condition as a target value in the rotational position of the respective photoconductors 40Y, 40M, 40C, and 40K is determined and applied to during image formation (e.g., printing). For example, the controller 500 determines control data of the developing bias applied to the developing roller in each of the developing devices 61Y, 61M, 61C, and 61K at the rotational position of the respective photoconductors 40Y, 40M, 40C, and 40K as the above correction data of image forming condition. Simultaneously, the controller 500 determines control data of the charging bias applied to the charging roller of each of the charging devices 60Y, 60M, 60C, and 60K at the rotational position of each of the photoconductors 40Y, 40M, 40C, and 40K as the above correction data of image forming condition as described below with reference to FIG. 10.

That is, the controller 500 produces a developing bias control table (e.g., a modulation table) that defines a relation between the rotational position of the respective photoconductors 40Y, 40M, 40C, and 40K and the control data of the developing bias. Similarly, the controller 500 produces a charging bias control table (e.g., a modulation table) that defines a relation between the rotational position of the respective photoconductors 40Y, 40M, 40C, and 40K and the control data of the charging bias. The controller 500 stores the developing bias control table and the charging bias control table therein in step S6.

How to control image forming conditions for the fluctuation of the image density in a cycle of a photoconductor (e.g., the photoconductors 40Y, 40M, 40C, and 40K) is described above with reference to the flowchart of FIG. 5. The fluctuation of the image density in a cycle of a developing roller of the respective developing devices 61Y, 61M, 61C, and 61K is also controlled similarly.

A detailed description about each step in FIG. 5 is provided below.

Figure 6:
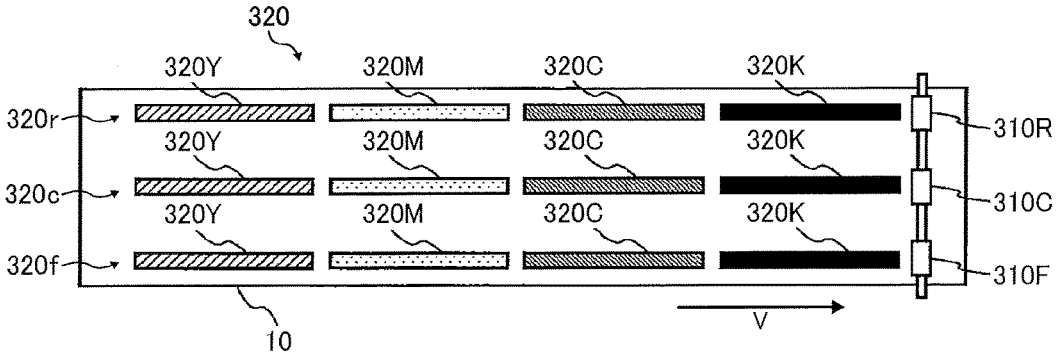
FIG. 6 is a schematic view of a toner image pattern used for the image density correction control illustrated in FIG. 5.

FIG. 6 is a schematic view of an example of the toner image patterns used in the image density correction control described above with reference to FIG. 5. The toner adhesion amount sensors 310 detect the toner image patterns at different positions in the main scanning direction illustrated in FIG. 6 and detect cyclic fluctuation of the toner adhesion amount in a sub-scanning direction. As illustrated in FIG. 6, the three toner adhesion amount sensors 310F, 310C, and 310R that detect the toner adhesion amount of toner image patterns 320 on the intermediate transfer belt 10 are located at three positions facing the front part (F), the center part (C), and the rear part (R), respectively, of the intermediate transfer belt 10 in the width direction (e.g., the main scanning direction) of the intermediate transfer belt 10. The toner image patterns 320 include multiple toner patches 320Y, 320M, 320C, and 320K aligned in a rotation direction V of the intermediate transfer belt 10 to form a belt shape. The toner patches 320Y, 320M, 320C, and 320K are disposed in each of the front part, the center part, and the rear part of the intermediate transfer belt 10, that are disposed opposite the toner adhesion amount sensors 310F, 310C, and 310R, respectively. The toner patches 320Y, 320M, 320C, and 320K has an identical image density. The toner adhesion amount sensor 310F detects the four toner patches 320Y, 320M, 320C, and 320K that are formed in the belt shape at the front part on the intermediate transfer belt 10. The toner adhesion amount sensor 310C detects the four toner patches 320Y, 320M, 320C, and 320K that are formed in the belt shape at the center part on the intermediate transfer belt 10. The toner adhesion amount sensor 310R detects the four toner patches 320Y, 320M, 320C, and 320K that are formed in the belt shape at the rear part of the intermediate transfer belt 10. Each of the toner patches 320Y, 320M, 320C, and 320K in each color has the identical image density. The detected results of the image density in each color (yellow, magenta, cyan, and black) indicate the cyclic fluctuation of the image density in the sub-scanning direction (e.g., the rotation direction V of the intermediate transfer belt 10) at the three positions, that is, the front part (F), the center part (C) and the rear part (R), in the width direction (e.g., the main scanning direction) of the intermediate transfer belt 10.

According to this illustrative embodiment, the intermediate transfer belt 10 is driven at a process linear velocity of 415 [mm/s]. The toner adhesion amounts of the toner image patterns 320 are detected at a sampling period of 1 [ms]. A length of each of the belt-shaped toner image patterns 320 in the sub-scanning direction (e.g., the rotation direction V of the intermediate transfer belt 10) is not smaller than at least a circumferential length of each of the photoconductors 40Y, 40M, 40C, and 40K and a circumferential length of each of the developing rollers in each color to calculate the fluctuation of the image density.

Alternatively, the length of each of the toner image patterns 320 in the rotation direction V of the intermediate transfer belt 10 may be not smaller than two times the circumferential length of each of the photoconductors 40Y, 40M, 40C, and 40K and the circumferential length of each of the developing rollers in each color. For example, each of the toner image patterns 320 has the length of 570 mm in the rotation direction V of the intermediate transfer belt 10. The length of 570 mm of each of the toner image patterns 320 is equivalent to three times the circumferential length of 190 [mm] of each of the photoconductors 40Y, 40M, 40C, and 40K.

According to this illustrative embodiment, the belt-shaped toner image patterns 320 are formed in four colors, respectively, as multiple solid image patterns with high image density. An image forming condition used to form an output toner image is controlled based on the detected fluctuation of the image density of the belt-shaped toner image patterns 320 (e.g., the multiple solid image patterns) in the sub-scanning direction (e.g., the rotation direction V of the intermediate transfer belt 10). The term "solid image pattern" means a pattern having a high image density within a detectable sensitivity range of the toner adhesion amount sensors 310. According to this illustrative embodiment, each of the toner patches 320Y, 320M, and 320C of each of the belt-shaped toner image patterns 320 (e.g., the multiple solid image patterns) has a high image density of 100%. The toner patch 320K of each of belt-shaped toner image patterns 320 may have an image density of about 70%.

As far as fluctuation of image density (e.g., variation in image density) is detected, the toner patches 320Y, 320M, 320C, and 320K aligned in the width direction of the intermediate transfer belt 10 (e.g., the main scanning direction) may be made of toner patches (e.g., half-tone patches) having an image density smaller than an image density of solid patches. For example, the belt-shaped toner image patterns 320 in each color may be formed as a plurality of half-tone patterns. A toner adhesion amount of the half-tone pattern is in a middle of the detectable sensitivity range of the toner adhesion amount sensors 310. The image density correction control that corrects an image forming condition used to form an output toner image may be performed based on the detected fluctuation of the image density of the belt-shaped toner image patterns 320 as the multiple half-tone patterns aligned in the sub-scanning direction (e.g., the rotation direction V of the intermediate transfer belt 10).

The toner patches 320Y, 320M, 320C, and 320K formed on the three positions on the intermediate transfer belt 10, that is, the front part, the center part, and the rear part, in the width direction of the intermediate transfer belt 10 (e.g., the main scanning direction) have an identical image density in each color (e.g., each of yellow, magenta, cyan, and black). For example, the toner patches 320K formed on the three positions, that is, the front part, the center part, and rear part on the intermediate transfer belt 10 in the width direction thereof in FIG. 6 (e.g., the main scanning direction) have an identical image density. The toner patches 320C formed on the three positions, that is, the front part, the center part, and the rear part, on the intermediate transfer belt 10 in the width direction thereof (e.g., the main scanning direction) have an identical image density. Similarly, the toner patches 320C have an identical image density. The toner patches 320K have an identical image density. Instead of the solid patches, the toner patches 320Y, 320M, 320C, and 320K may be half-tone patches.

The image density correction control using the solid patches may be combined with the image density correction control using the half-tone patches. For example, one of the image formation conditions used to form an output toner image (e.g., the developing bias) may be corrected based on the results of the detected cyclic fluctuations in the image density of the multiple solid patches. Another one of the image formation conditions used to form the output toner image (e.g., the charging bias) may be corrected based on the results of the detected cyclic fluctuations in the image density of the multiple half-tone patches.

Figure 7A:
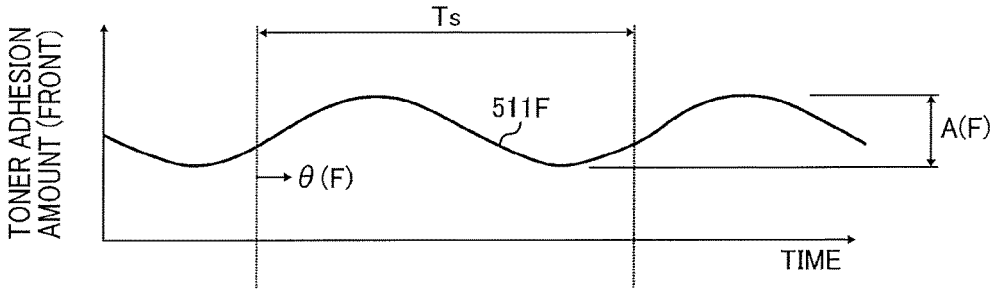
FIG. 7A is a graph illustrating a relation between time and toner adhesion amount of a toner image pattern formed on a front part of an intermediate transfer belt incorporated in the image forming apparatus illustrated in FIG. 1.
Figure 7B:
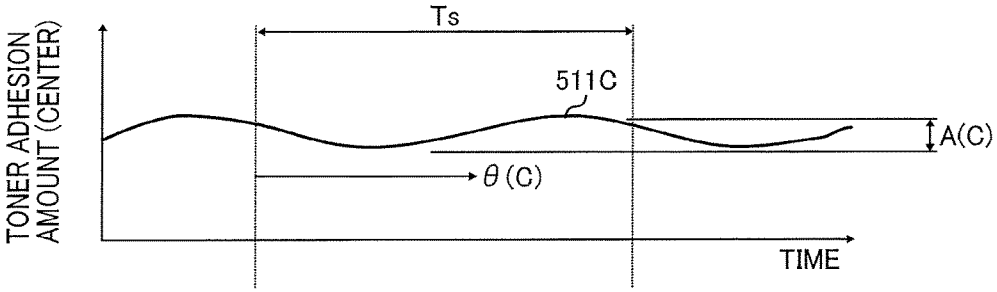
FIG. 7B is a graph illustrating the relation between time and toner adhesion amount of a toner image pattern formed on a center part of the intermediate transfer belt incorporated in the image forming apparatus illustrated in FIG. 1.
Figure 7C:
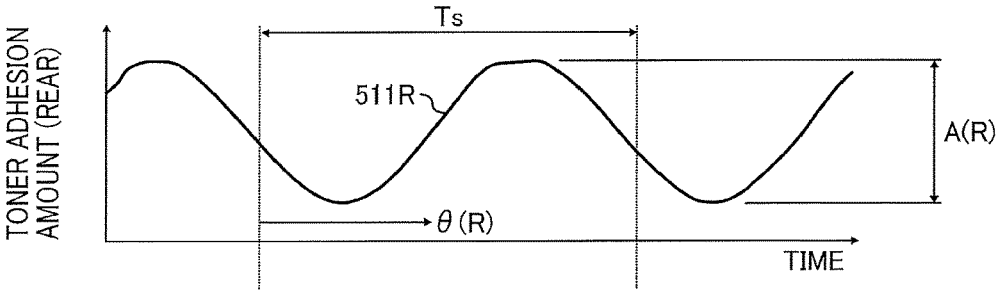
FIG. 7C is a graph illustrating the relation between time and toner adhesion amount of a toner image pattern formed on a rear part of the intermediate transfer belt incorporated in the image forming apparatus illustrated in FIG. 1.
Figure 7D:
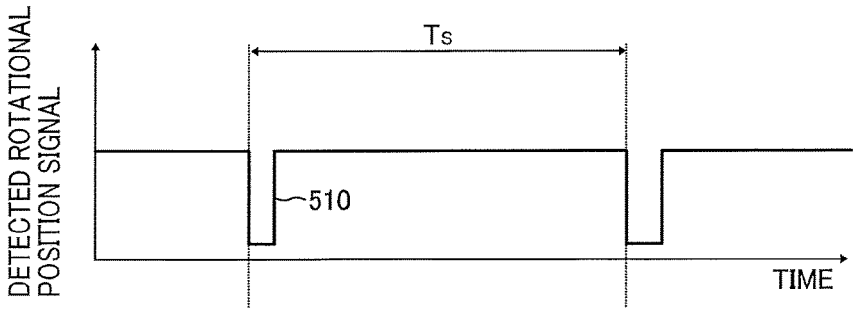
FIG. 7D is a graph illustrating a relation between time and rotational position signal generated when the toner image pattern illustrated in FIG. 6 is detected.

FIGS. 7A, 7B, 7C, and 7D illustrate an explanatory view illustrating an example of a measurement that measures rotational position signals of the photoconductors 40Y, 40M, 40C, and 40K and toner adhesion amounts detected by the toner adhesion amount sensors 310 when the toner adhesion amount sensors 310 detect one of the toner image patterns 320 illustrated in FIG. 6. FIG. 7A is a graph illustrating an example of the measurement that measures the toner adhesion amount (e.g., an image density of a toner image) detected by the toner adhesion amount sensor 310F that detects a front toner image pattern 320*f* disposed at a front of the intermediate transfer belt 10 in the main scanning direction illustrated in FIG. 6. FIG. 7B is a graph illustrating an example of the measurement that measures the toner adhesion amount (e.g., an image density of a toner image) detected by the toner adhesion amount sensor 310C that detects a center toner image pattern 320*c* disposed at a center of the intermediate transfer belt 10 in the main scanning direction illustrated in FIG. 6. FIG. 7C is a graph illustrating an example of the measurement that measures the toner adhesion amount (e.g., an image density of a toner image) detected by the toner adhesion amount sensor 310R that detects a rear toner image pattern 320*r* disposed at a rear of the intermediate transfer belt 10 in the main scanning direction illustrated in FIG. 6. FIG. 7D is a graph illustrating an example of measurement of the rotational position signals with one of the photointerrupters represented by the photointerrupter 71K depicted in FIG. 2 that detect the rotational position of the photoconductors 40Y, 40M, 40C, and 40K when one of the toner image patterns 320 illustrated in FIG. 6 is detected.

The example illustrated in FIG. 7D is an example of the measurement obtained when rotational position signals of the photoconductors 40Y, 40M, 40C, and 40K and output signals of the toner adhesion amount sensors 310 are measured in parallel. Similar results are obtained when rotational position signals of the developing roller and signals of the toner adhesion amount sensors 310 are measured in parallel.

As illustrated in FIGS. 7A, 7B, and 7C, the toner adhesion amount detected by the toner adhesion amount sensors 310 changes at a cycle identical to a cycle of the rotational position signal. Fluctuations of the toner adhesion amount at the front part, the center part, and the rear part of the intermediate transfer belt 10 in the main scanning direction (e.g., the width direction of the intermediate transfer belt 10) are fitted in a form of a sine wave based on the rotational position signals of the photoconductors 40Y, 40M, 40C, and 40K, which are detected by the photointerrupters 71, respectively. Quadrature detection is used for fitting of the sine wave according to this illustrative embodiment.

The results of the quadrature detection are presented as the following equations (1), (2), and (3) that mean the fluctuations of the toner adhesion amount at the front part, the center part, and the rear part of the intermediate transfer belt 10 in width direction thereof (e.g., the main scanning direction). In the equations (1), (2), and (3), A(F) and θ(F) represent the amplitude and the phase of the fluctuation of the toner adhesion amount at the front part of the intermediate transfer belt 10. A(C) and θ(C) represent the amplitude and the phase of the fluctuation of the toner adhesion amount at the center part of the intermediate transfer belt 10. A(R and θ(R) represent the amplitude and the phase of the fluctuation of the toner adhesion amount at the rear part of the intermediate transfer belt 10.

$$Qf=Vf+A(F)\times\sin(\omega t+\theta(F)) \quad (1)$$

In the equation (1), Qf represents the toner adhesion amount at the front part of the intermediate transfer belt 10. Vf represents an average toner adhesion amount at the front part of the intermediate transfer belt 10.

$$Qc=Fc+A(C)\times\sin(\omega t+\theta(C)) \quad (2)$$

In the equation (2), Qc represents the toner adhesion amount at the center part of the intermediate transfer belt 10. Vc represents an average toner adhesion amount at the center part of the intermediate transfer belt 10.

$$Qr=Vr+A(R)\times\sin(\omega t+\theta(R)) \quad (3)$$

In the equation (3), Qr represents the toner adhesion amount at the rear part of the intermediate transfer belt 10. Vr represents an average toner adhesion amount at the rear part of the intermediate transfer belt 10.

The developing bias control table and the charging bias control table are determined separately to fit the amplitude and the phase at each of the front part, the center part, and the rear part of the intermediate transfer belt 10 in the main scanning direction. However, in each of the developing bias control table and the charging bias control table, the value is even in the main scanning direction. To address this circumstance, according to this illustrative embodiment, considering the amplitude and the phase at the front part, the center part, and the rear part of the intermediate transfer belt 10 in the main scanning direction, appropriate amplitude and phase (A (cor), θ (cor)) to be corrected by the developing bias control table and the charging bias control table are calculated.

Figure 8A:
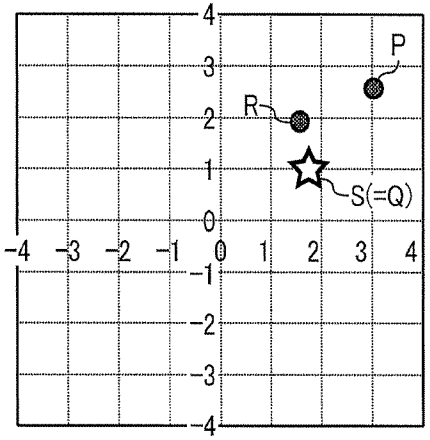
FIG. 8A is a graph illustrating points plotted on polar coordinates, which represent an amplitude and a phase indicating a fluctuation of the toner adhesion amount of the toner pattern illustrated in FIG. 6 when a phase difference between the front part, the center par, and the rear part of the intermediate transfer belt is small.
Figure 8B:
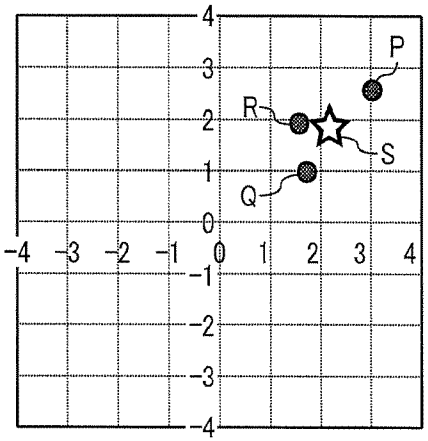
FIG. 8B is another graph illustrating points plotted on the polar coordinates, which represent the amplitude and the phase indicating the fluctuation of the toner adhesion amount of the toner pattern illustrated in FIG. 6 when the phase difference between the front part, the center par, and the rear part of the intermediate transfer belt is small.
Figure 8C:
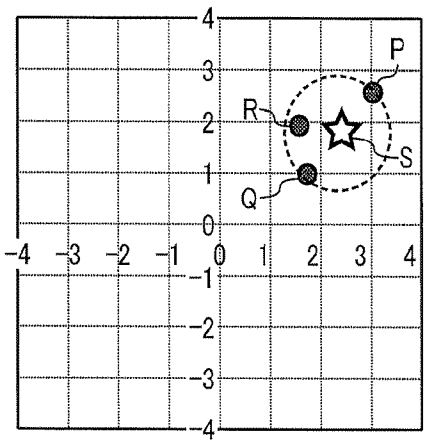
FIG. 8C is yet another graph illustrating points plotted on the polar coordinates, which represent the amplitude and the phase indicating the fluctuation of the toner adhesion amount of the toner pattern illustrated in FIG. 6 when the phase difference between the front part, the center par, and the rear part of the intermediate transfer belt is small.
Figure 8D:
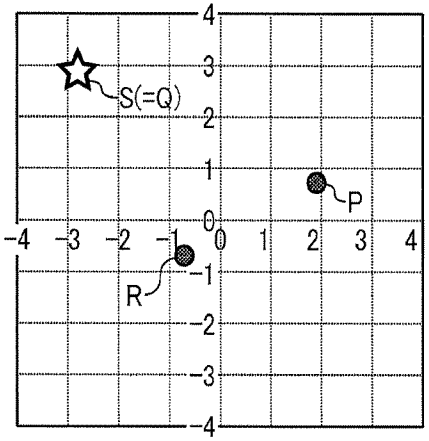
FIG. 8D is yet another graph illustrating points plotted on the polar coordinates, which represent the amplitude and the phase indicating the fluctuation of the toner adhesion amount of the toner pattern illustrated in FIG. 6 when the phase difference between the front part, the center par, and the rear part of the intermediate transfer belt is great.
Figure 8E:
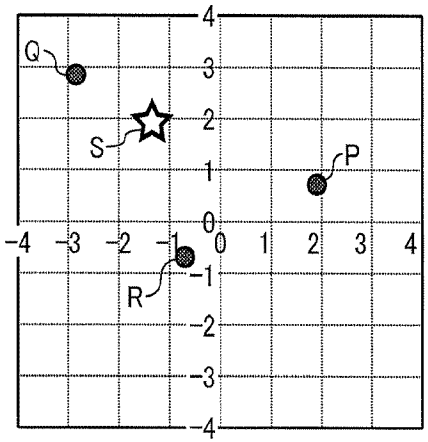
FIG. 8E is yet another graph illustrating points plotted on the polar coordinates, which represent the amplitude and the phase indicating the fluctuation of the toner adhesion amount of the toner pattern illustrated in FIG. 6 when the phase difference between the front part, the center par, and the rear part of the intermediate transfer belt is great.
Figure 8F:
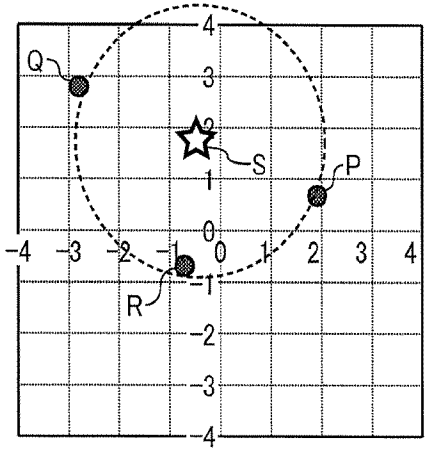
FIG. 8F is yet another graph illustrating points plotted on the polar coordinates, which represent the amplitude and the phase indicating the fluctuation of the toner adhesion amount of the toner pattern illustrated in FIG. 6 when the phase difference between the front part, the center par, and the rear part of the intermediate transfer belt is great.

FIGS. 8A, 8B, 8C, 8D, 8E, and 8F illustrate a graph in which amplitudes and phases of the fluctuation of the toner adhesion amount detected at the front part, the center part, and the rear part of the intermediate transfer belt 10 in the main scanning direction as described above with reference to FIGS. 7A, 7B, 7C, and 7D are plotted at polar coordinates. A distance from the origin of the graph represents an amplitude A and an angle defined from the X axis of the graph represents a phase θ. Points, P, Q, and R in FIGS. 8A to 8F are points representing the amplitude and the phase of the fluctuation of the toner adhesion amount at the front part, the center part, and the rear part of the intermediate transfer belt 10, respectively. A star mark S is the point representing the appropriate amplitude and phase for correction. FIGS. 8A to 8C illustrate an example in which a phase difference between the front part, the center part, and the rear part of the intermediate transfer belt 10 in the main scanning direction is small. FIGS. 8D to 8F illustrate an example in which the phase difference between the front part, the center part, and the rear part of the intermediate transfer belt 10 in the main scanning direction is great.

In three graphs illustrated in FIGS. 8A to 8C, three points, P, Q, and R, are plotted. The coordinates of the point P are (4.0, 40°) that are the amplitude and the phase of the fluctuation of the toner adhesion amount detected at the front part of the intermediate transfer belt 10. The coordinates of the point Q are (2.0, 30°) that are the amplitude and the phase of the fluctuation of the toner adhesion amount detected at the center part of the intermediate transfer belt 10. The coordinates of the point R are (2.5, 50°) that are the amplitude and the phase of the fluctuation of the toner adhesion amount detected at the rear part of the intermediate transfer belt 10. Three methods for determining the amplitude and the phase of the fluctuation of the toner adhesion amount to be corrected based on the above data are compared below.

Table 1 represents the amplitude, the phase, and the X and Y coordinates of the points, P, Q, R, and S representing a case illustrated in FIGS. 8A to 8C in which the phase difference between the front part, the center part, and the rear part of the intermediate transfer belt 10 in the main scanning direction is small. Table 2 represents the amplitude of the fluctuation of the toner adhesion amount after correction based on the data in Table 1.

TABLE 1

| | | Amplitude | Phase (°) | X | Y |
|---|---|---|---|---|---|
| P (Front part) | | 4.0 | 40 | 3.06 | 2.57 |
| Q (Center part) | | 2.0 | 30 | 1.73 | 1.00 |
| R (Rear part) | | 2.5 | 50 | 1.61 | 1.92 |
| S | Single position detecting method | 2.0 | 30 | 1.73 | 1.00 |
| | Averaging method | 2.8 | 40 | 2.17 | 1.82 |
| | Minimum covering circle method | 3.0 | 37 | 2.40 | 1.79 |

TABLE 2

| | Amplitude of fluctuation of toner adhesion amount after correction | | |
|---|---|---|---|
| | Single position detecting method | Averaging method | Minimum covering circle method |
| P (Front part) | 2.06 | 1.17 | 1.03 |
| Q (Center part) | 0.00 | 0.93 | 1.03 |
| R (Rear part) | 0.92 | 0.57 | 0.80 |

Table 1 represents the three control methods. A first method is a conventional method in which the toner adhesion amount is detected at a single position (e.g., the center part of the intermediate transfer belt 10). The first method is hereinafter referred to as a single position detecting method. A second method uses an average of amplitudes and phases that are detected at multiple positions. The second method is hereinafter referred to as an averaging method. A third method uses a minimum covering circle including a plurality of points whose polar coordinates are amplitudes and phases of the fluctuation of the toner adhesion amount detected at multiple positions. The polar coordinates of a center point of the circle is used as the amplitude and the phase to be controlled. The third method is hereinafter referred to as a minimum covering circle method.

Firstly, the single position detecting method as the conventional method is described. The point S, having the amplitude of 2.0 and the phase of 30°, that means a suitable amplitude and phase to be corrected coincides the point Q that means the amplitude and the phase of the fluctuation of the toner adhesion amount at the center part of the intermediate transfer belt 10, as illustrated in FIG. 8A. An amplitude of a residual error in the fluctuation of the toner adhesion amount after correction, that is, the accuracy of control is represented by the distance between the point S and other points. As represented in Table 2, a distance between the point S and the point P at the front part of the intermediate transfer belt 10 is 2.06. A distance between the point S and the point Q at the center part of the intermediate transfer belt 10 is 0.00. A distance between the point S and the point R at the rear part of the intermediate transfer belt 10 is 0.92. In this case, a maximum value (e.g., a worst value) is 2.06 at the front part of the intermediate transfer belt 10. The amplitude of the fluctuation of the toner adhesion amount is 4.00 before correction. Therefore, the single position detecting method decreases the amplitude of the fluctuation of the toner adhesion amount from 4.00 to 2.06 when the phase difference of the fluctuation of the toner adhesion amount before correction does not vary substantially among the front part, the center part, and the rear part of the intermediate transfer belt 10.

Secondly, the averaging method is described. The amplitude to be corrected is the average of 4.0, 2.0, and 2.5, that is, 2.8. The phase to be corrected is the average of 40°, 30°, and 50°, that is, 40°. Therefore, the coordinates of point S are (2.8, 40°). The point S is marked with a star in FIG. 8B. In this case, the residual errors after correction (e.g., the accuracy of correction) are 1.17 at the front part, 0.93 at the center part, and 0.57 at the rear part of the intermediate transfer belt 10 as represented in Table 2. Therefore, the maximum value (e.g., the worst value) is 1.17 at the front part of the intermediate transfer belt 10. Thus, the single position detecting method and the averaging method decrease the amplitude of the fluctuation of the toner adhesion amount sufficiently when the phase difference of the fluctuation of the toner adhesion amount before correction does not vary substantially among the front part, the center part, and the rear part of the intermediate transfer belt 10.

Thirdly, the minimum covering circle method is described. The center point of the minimum covering circle including the three points, P, Q, and R as illustrated in FIG. 8C is calculated. In this case, the coordinates of the point S are (3.0, 37°). The point S is marked with a star in FIG. 8C. In this case, the residual errors after correction (e.g., the accuracy of correction) is 1.03 at the front part, 1.03 at the center part, and 0.80 at the rear part of the intermediate transfer belt 10 as represented in Table 2. Therefore, the maximum value (e.g., the worst value) is 1.03 at the front part and the center part of the intermediate transfer belt 10. Thus, the minimum covering circle method decreases the amplitude of the fluctuation of the toner adhesion amount compared with the single position detecting method and the averaging method.

On the other hand, FIGS. 8D to 8F illustrate an example in which the phase of the fluctuation of the toner adhesion amount before correction varies substantially between the front part, the center part, and the rear part of the intermediate transfer belt 10. Specifically, the coordinates of the point P are (2.0, 20°) that are the amplitude and the phase of the fluctuation of the toner adhesion amount detected at the front part of the intermediate transfer belt 10. The coordinates of the point Q are (4.0, 135°) that are the amplitude and the phase of the fluctuation of the toner adhesion amount detected at the center part of the intermediate transfer belt 10. The coordinates of the point R are (1.0, 225°) that are the amplitude and the phase of the fluctuation of the toner adhesion amount detected at the rear part of the intermediate transfer belt 10. In this case, under the single position detecting method, the coordinates of the point S are (4.0, 135°) that are the amplitude and the phase to be corrected as illustrated in FIG. 8D. The residual errors after correction (e.g., the accuracy of correction) are 5.17 at the front part, 0.00 at the center part, and 4.12 at the rear part of the intermediate transfer belt 10. Therefore, the maximum value (e.g., the worst value) is 5.17. Since the amplitude of the fluctuation of the toner adhesion amount is 4.00 before correction, the fluctuation of the image density worsens.

Table 3 represents the amplitude, the phase, and the X and Y coordinates of the points, P, Q, R, and S in a case illustrated in FIGS. 8D to 8F in which the phase difference between the front part, the center part, and the rear part of the intermediate transfer belt 10 in the main scanning direction is small. Table 4 represents the amplitude of the fluctuation of the toner adhesion amount after correction based on the data in Table 3.

TABLE 3

| | | Amplitude | Phase (°) | X | Y |
|---|---|---|---|---|---|
| P (Front part) | | 2.0 | 20 | 1.88 | 0.68 |
| Q (Center part) | | 4.0 | 135 | −2.83 | 2.83 |
| R (Rear part) | | 1.0 | 225 | −0.71 | −0.71 |
| S | Single position detecting method | 4.0 | 135 | −2.83 | 2.83 |
| | Averaging method | 2.3 | 127 | −1.39 | 1.87 |
| | Minimum covering circle method | 1.8 | 105 | −0.47 | 1.76 |

TABLE 4

| | Amplitude of fluctuation of toner adhesion amount after correction | | |
|---|---|---|---|
| | Single position detecting method | Averaging method | Minimum covering circle method |
| P (Front part) | 5.17 | 3.48 | 2.59 |
| Q (Center part) | 0.00 | 1.72 | 2.59 |
| R (Rear part) | 4.12 | 2.67 | 2.47 |

In the averaging method, the coordinates of the point S that mean the amplitude an the phase to be corrected are (2.3, 127°) as illustrated in FIG. 8E. The residual errors after correction (e.g., the accuracy of correction) are 3.48 at the front part, 1.72 at the center part, and 2.67 at the rear part of the intermediate transfer belt 10 that are represented in Table 4. Therefore, the maximum value (e.g., the worst value) is 3.48. The value of 3.48 is smaller than 4.00, that is, the amplitude of the fluctuation of the toner adhesion amount before correction.

Next, the minimum covering circle method applied to this case is described. The minimum covering circle has a smallest radius and includes all points calculated from the data within the circle. When the number of detection points is three as in this illustrative embodiment, a center of the minimum covering circle is a center of a longest side of an obtuse triangle defined by three points on corners of the obtuse triangle or a circumcenter (e.g., a center of a circumcircle) of an acute triangle defined by three points on corners of the acute triangle.

For example, when coordinates of points calculated from detected data are illustrated in FIG. 8F, the point S defining the center of the minimum covering circle has coordinates of (1.8, 105°). The point S is marked with a star in FIG. 8F. In this case, the residual errors after correction about the amplitude of the fluctuation of the toner adhesion amount, that is, the accuracy of the control, are 2.59 at the front part of the intermediate transfer belt 10 which represents the distance between the point P and the point S, 2.59 at the center part of the intermediate transfer belt 10 which represents the distance between the point R and the point S, and 2.47 at the rear part of the intermediate transfer belt 10 which represents the distance between the point Q and the point S. Therefore, the maximum value (e.g., the worst value) is 2.59 at the front part or the center part of the intermediate transfer belt 10. Thus, the minimum covering circle method decreases the amplitude of the fluctuation of the toner adhesion amount from 4.00 to 2.59 substantially by correction even if the phase difference of the fluctuation of the toner adhesion amount before correction varies substantially between the front part, the center part, and the rear part of the intermediate transfer belt 10.

Instead of the minimum covering circle method, a barycentric method may be used. In this method, the amplitude and the phase of the fluctuation of the toner adhesion amount detected at multiple positions are plotted in the polar coordinates, a barycenter of the plotted points is calculated and the coordinates of the barycenter are chosen as the amplitude and the phase to be corrected.

Figure 9A:
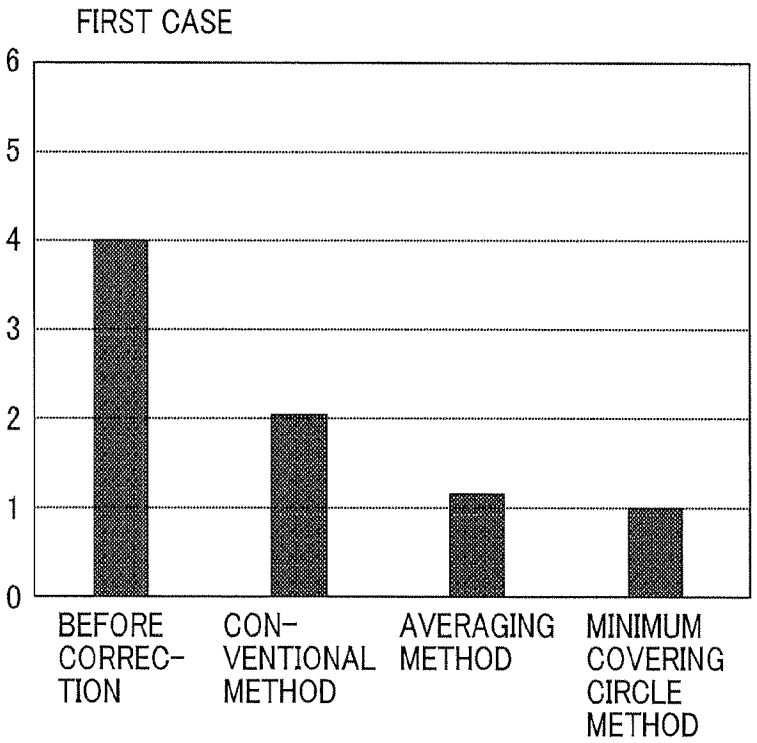
FIG. 9A is a graph that compares residual errors after the image density correction control illustrated in FIG. 5 in a first case in which the phase difference is small.
Figure 9B:
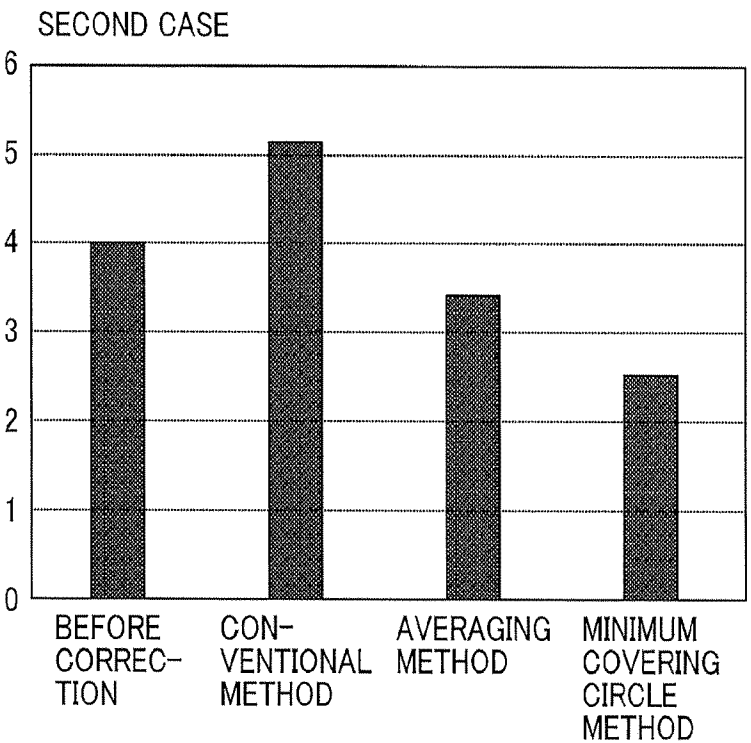
FIG. 9B is a graph that compares the residual errors after the image density correction control illustrated in FIG. 5 in a second case in which the phase difference is great.

In FIGS. 9A and 9B, the amplitude of the fluctuation of the toner adhesion amount before correction and the amplitude of the fluctuation of the toner adhesion amount after correction (e.g., the residual error and the accuracy of correction) in the above-described methods are compared. FIG. 9A illustrates a first case that the phase difference between detected positions (e.g., the front part, the center part, and the rear part of the intermediate transfer belt 10) in the main scanning direction is small. FIG. 9B illustrates a second case that the phase difference between the detected positions in the main scanning direction is great. When the phase difference between the detected positions in the main scanning direction is small, the conventional single position detecting method decreases the fluctuation sufficiently as illustrated in FIG. 9A. However, when the phase difference between the detected positions in the main scanning direction is great, the conventional single position detecting method increases the fluctuation as illustrated in FIG. 9B. Conversely, the minimum covering circle method according to this illustrative embodiment decreases the fluctuation in the above two cases.

Figure 10:
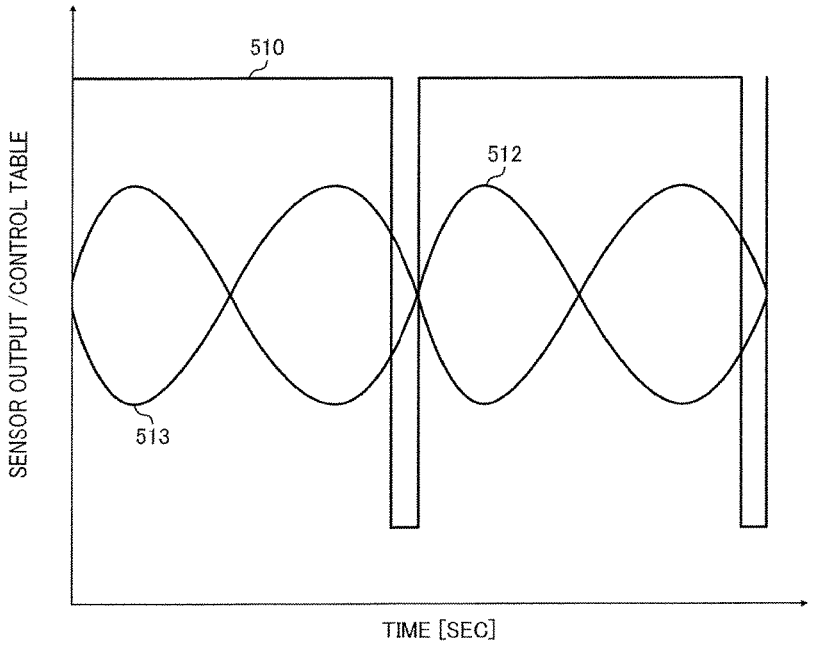
FIG. 10 is a graph illustrating a relation between time and a control table of an image forming condition determined by the controller illustrated in FIG. 4.

FIG. 10 is a schematic view to explain how an image forming condition is controlled in the illustrative embodiments illustrated in FIG. 5. FIG. 10 illustrates an example of a relation between a rotational position detection signal 510 illustrated in FIG. 7B and a calculated correction signal 512 calculated by the minimum covering circle method based on a plurality of toner adhesion amount detection signals 511F, 511C, and 511R illustrated in FIGS. 7A, 7B, and 7C, respectively. The data presented in FIGS. 7A, 7B, 7C, and 7D are detected when predetermined toner image patterns are formed. FIG. 10 also illustrates an example of a relation between the rotational position detection signal 510 and control data 513 (e.g., a control table) of the image forming condition determined by the controller 500 based on the rotational position detection signal 510 and the calculated correction signal 512. The data illustrated in FIG. 10 is an example of a measurement in two cycles of a rotating body (e.g., one of the photoconductors 40Y, 40M, 40C, and 40K or the developing roller) The calculated correction signal 512 fluctuates in a cycle identical to a cycle of the rotational position detection signal 510. The control table including the control data 513 for image forming condition relating to the rotational position of the rotating body is determined such that the control data 513 has a phase opposite a phase of the calculated correction signal 512. A developing bias and a charging bias are an actual parameter of the image density control. The developing bias and the charging bias may have a negative polarity. When the absolute value of the developing bias and the charging bias increases, the toner adhesion amount may decrease. To address this circumstance, although the above term "a phase opposite a phase" may not be appropriate, control data (e.g., the control table) is prepared to decrease the fluctuation of the toner adhesion amount indicted by the calculated correction signal 512. That is, the term "a phase opposite a phase" means preparing the control table that produces a fluctuation of a toner adhesion amount opposite to the fluctuation of the toner adhesion amount indicated by the calculated correction signal 512.

Ideally, a gain in generating the control table is determined according to theoretical values. In practice, however, the gain is determined according to data obtained through experimentation to verify the theoretical values in a commercial apparatus. The term "gain" is a parameter that determine a fluctuation amount [V] of the control data in the control table with respect to the fluctuation amount [V] of the toner adhesion amount detection signals 511F, 511C, and 511R [V]. The control table that has the control data 513 created using the thus-determined gain has a timed relation as illustrated in FIG. 10 with the rotational position detection signal 510. In the illustrated example, a leading end of the control table corresponds to an occurrence of the rotational position detection signal 510. Herein, if the control table is a developing bias control table, a time to apply the control table is determined considering each distance between each of developing nips (e.g., a position that each of the developing rollers faces each of the photoconductors 40Y, 40M, 40C, and 40K) and each of the toner adhesion amount sensors 310. If the distance between the development nip and the toner adhesion amount sensor 310 is an integer multiple of a circumferential length of each of the photoconductors 40Y, 40M, 40C, and 40K, the control data 513 is applied from a leading end of the control data 513 in sync with the rotational position detection signal 510. If the distance between the development nip and the toner adhesion amount sensor 310 is not an integer multiple of the circumferential length of each of the photoconductors 40Y, 40M, 40C, and 40K, the control data 513 is applied by shifting a time period corresponding to a difference between the distance between the development nip and the toner adhesion amount sensor 310 and an integer multiple of the circumferential length of each of the photoconductors 40Y, 40M, 40C, and 40K.

In the above description, the developing bias is fluctuated cyclically. Similarly, the charging bias is fluctuated. If the control table is the charging bias control table made of control data for the charging bias, the charging bias control table is applied taking into consideration the distance between a charging position where the charging devices 60Y, 60M, 60C, and 60K charge the photoconductors 40Y, 40M, 40C, and 40K, respectively, and the toner adhesion amount sensor 310.

At least one of a photoconductor (e.g., the photoconductors 40Y, 40M, 40C, and 40K) and a developing device (e.g., the developing devices 61Y, 61M, 61C, and 61K) may be detachably attached to the body 100 of the image forming apparatus 1 according to this illustrative embodiment to facilitate maintenance. The photointerrupters 71 and 72 serving as the rotational position detector may be located inside the body 100. Thus, the photointerrupters 71 and 72 are not replaced with the photoconductor or the developing device, decreasing running costs.

A description is provided of a second illustrative embodiment of calculation of the amplitude data and the phase data of the fluctuation of the toner image density (e.g., the toner adhesion amount).

Figure 11:
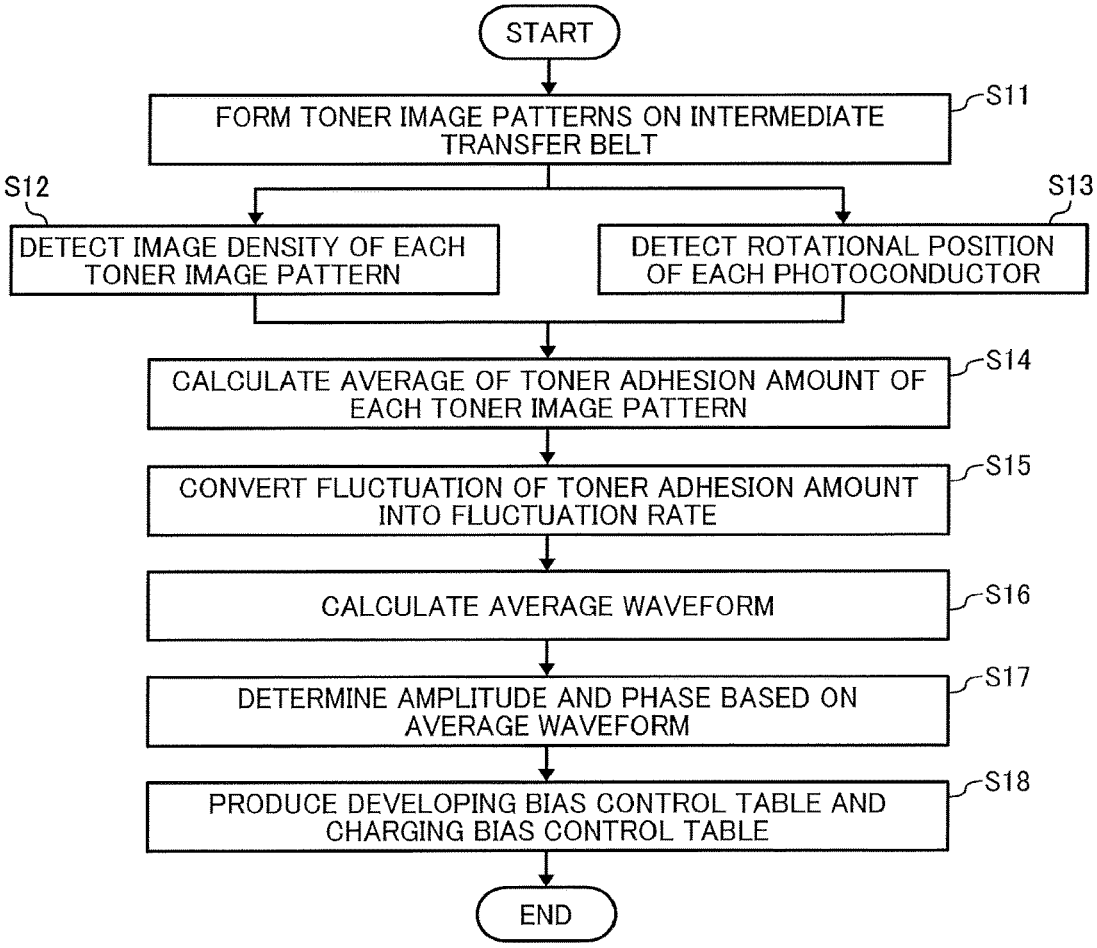
FIG. 11 is a flowchart of the image density correction control according to a second illustrative embodiment that is performed by the controller illustrated in FIG. 4.

FIG. 11 is a flowchart illustrating one example of the image density correction control performed by the image forming apparatus 1 according to the second illustrative embodiment that corrects a cyclic fluctuation of the image density. The image forming apparatus 1 according to the second illustrative embodiment includes the multiple toner adhesion amount sensors 310 aligned in the main scanning direction perpendicular to the rotation direction V of the intermediate transfer belt 10 and corrects the cyclic fluctuation of the image density based on the detected results by the multiple toner adhesion amount sensors 310.

Figure 12:
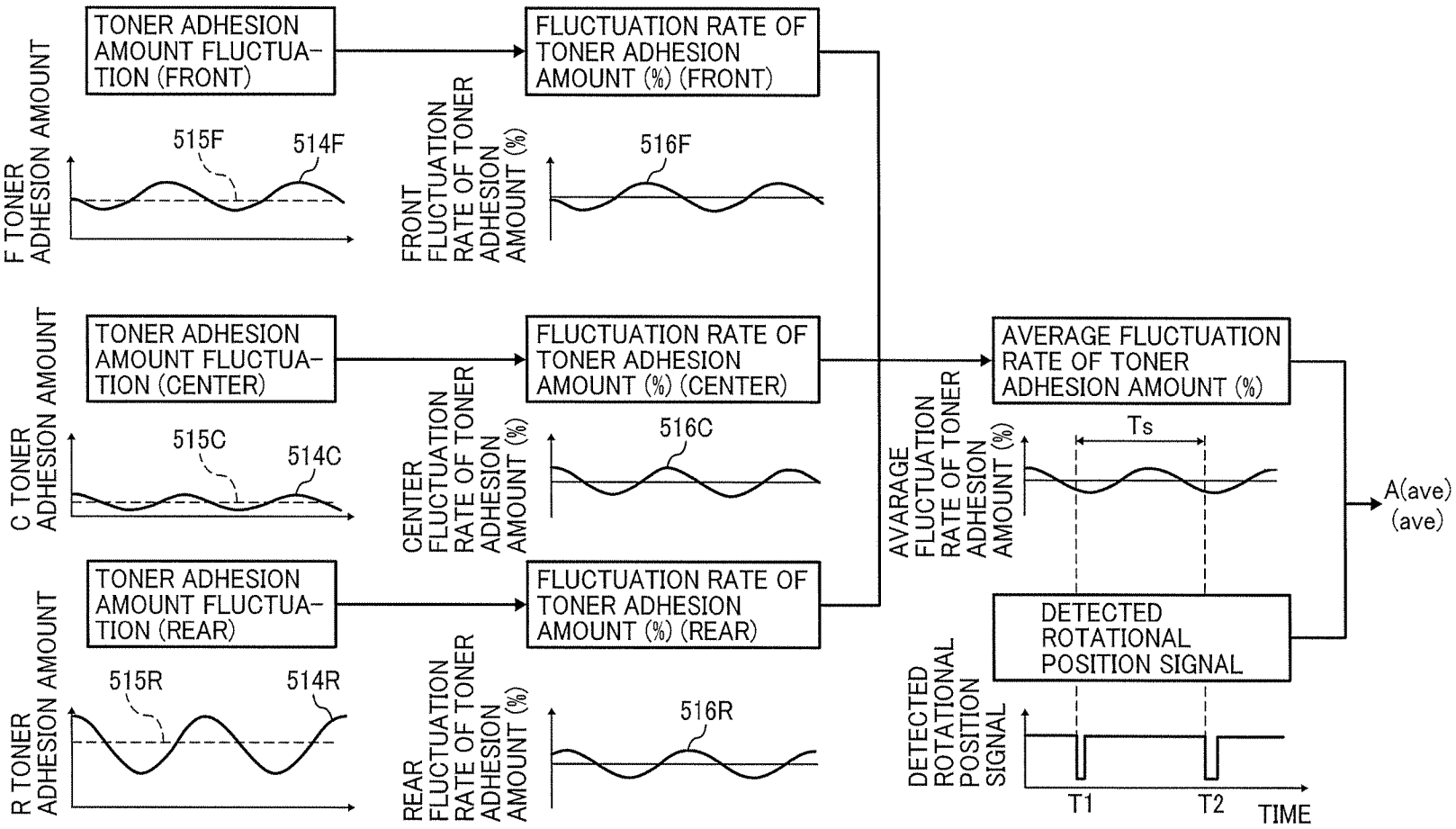
FIG. 12 is an explanatory view illustrating a procedure of determining amplitude data and phase data to be corrected under the image density correction control according to the second embodiment illustrated in FIG. 11.

Firstly, the image forming units 18Y, 18M, 18C, and 18K form the multiple toner image patterns 320 (e.g., the solid image patterns) depicted in FIG. 6 having a predetermined image density at multiple predetermined positions on each of photoconductors 40Y, 40M, 40C, and 40K in the main scanning direction in step S11. Positions of the toner image patterns 320 in the main scanning direction are the three points, the front part, the center part, and the rear part of the intermediate transfer belt 10 in the main scanning direction. The multiple toner adhesion amount sensors 310F, 310C, and 310R are located at the positions where the toner adhesion amount sensors 310F, 310C, and 310R detect the toner image patterns 320. A toner image pattern (e.g., a solid image pattern) in each color may be used as the toner image patterns 320 if the multiple toner adhesion amount sensors 310F, 310C, and 310R detect the toner adhesion amount of the toner image pattern. The multiple toner adhesion amount sensors 310F, 310C, and 310R detect the image density (e.g., the toner adhesion amount) of the toner image patterns 320 on the intermediate transfer belt 10 in step S12. In parallel to the image density detection (e.g., the toner adhesion amount detection) of the toner image patterns 320, the photointerrupters 71 detect the rotational position of each of the photoconductors 40Y, 40M, 40C, and 40K in step S13. As a result, fluctuating output signals corresponding to the image density (e.g., the toner adhesion amounts) described below with reference to FIG. 12 are obtained. According to the illustrative embodiments described above, the three toner image patterns 320 are produced in the main scanning direction. Alternatively, the number of the toner image patterns 320 in the main scanning direction is not limited to three. For example, four or more toner image patterns 320 may be produced.

Next, the controller 500 calculates an average toner adhesion amount (e.g., an average toner image density) of the toner adhesion amounts detected at the three positions based on toner adhesion amount signals (e.g., toner image density signals) in multiple cycles detected by the multiple toner adhesion amount sensors 310F, 310C, and 310R in step S14 as illustrated in FIG. 12.

Next, using the rotational position signal detected by the photointerrupter 71 for each of the photoconductors 40Y, 40M, 40C, and 40K and the average toner adhesion amount at the three positions calculated from each of the toner adhesion amount signals of the multiple toner adhesion amount sensors 310F, 310C, and 310R, the controller 500 converts fluctuation of each of the toner adhesion amounts into a fluctuation rate [%] of the toner adhesion amount in step S15 as illustrated in FIG. 12. The fluctuation rate [%] of the toner adhesion amount indicates a degree of variability based on an average of a waveform of the toner adhesion amount signal and is defined by the following equation (4). In the following equation (4), Ao represents the average of the waveform of the toner adhesion amounts (e.g., average toner adhesion amounts 515F, 515C, and 515R depicted in FIG. 12). A(t) represents an amplitude of a waveform of the toner adhesion amount at a time t. Fr represents a fluctuation rate [%] of the toner adhesion amount.

$$Fr=\{A(t)-Ao\}/Ao\times 100 \quad (4)$$

The controller 500 averages three fluctuation rates [%] of the toner adhesion amount. The controller 500 calculates an average waveform of the fluctuation rates of the toner adhesion amount in step S16 as illustrated in FIG. 12.

Next, the controller 500 determines one amplitude data and one phase data to be corrected in each color based on the above average waveform of the fluctuation rate of the toner adhesion amount in step S17.

Based on the determined phase data and the determined amplitude data to be corrected, control data as target values of the image forming condition for the rotational position of each of the photoconductors 40Y, 40M, 40C, and 40K are determined and applied to each printing. For example, the controller 500 determines control data of the developing bias applied to the developing roller of each of the developing devices 61Y, 61M, 61C, and 61K at the rotational position of each of the photoconductors 40Y, 40M, 40C, and 40K as the above control data of the image forming condition. Simultaneously, the controller 500 determines control data of the charging bias applied to the charging roller of each of the charging devices 60Y, 60M, 60C, and 60K at the rotational position of each of the photoconductors 40Y, 40M, 40C, and 40K as the above control data of the image forming condition as illustrated in FIG. 10. The controller 500 produces and stores a developing bias control table corresponding to a relation between the rotational position of each of the photoconductors 40Y, 40M, 40C, and 40K and the control data of the developing bias and a charging bias control table corresponding to a relation between the rotational position of each of the photoconductors 40Y, 40M, 40C, and 40K and the control data of the charging bias in step S18.

Calculation of the amplitude data and the phase data of the fluctuation of the toner adhesion amount is described more concretely. FIG. 12 is an explanatory view illustrating a procedure of determining the amplitude data and the phase data to be corrected based on results of a measurement of rotational position signals from the photointerrupters 71 and output signals from the toner adhesion amount sensors 310F, 310C, and 310R when the toner adhesion amount sensors 310F, 310C, and 310R detect the toner image patterns 320 illustrated in FIG. 6. According to the second illustrative embodiment, the toner patches 320Y, 320M, 320C, and 320K illustrated in FIG. 6 are formed. The length of each of the belt-shaped toner image patterns 320*f*, 320*c*, and 320*r*, each of which is constructed of the toner patches 320Y, 320M, 320C, and 320K, in the rotation direction V of the intermediate transfer belt 10 is 600 [mm] that is longer than three times the circumferential length of 190 [mm] of each of the photoconductors 40Y, 40M, 40C, and 40K.

The graph on the top of the left side in FIG. 12 is an example of a measurement of the toner adhesion amount (e.g., the image density) of the toner image pattern 320*f* situated at the front part of the intermediate transfer belt 10 in the main scanning direction illustrated in FIG. 6. The toner adhesion amount sensor 310F generates a toner adhesion amount detection signal 514F that indicates the toner adhesion amount. The graph on the second top of the left side in FIG. 12 is an example of a measurement of the toner adhesion amount (e.g., the image density) of the toner image pattern 320*c* situated at the center part of the intermediate transfer belt 10 in the main scanning direction illustrated in FIG. 6. The toner adhesion amount sensor 310C generates a toner adhesion amount detection signal 514C that indicates the toner adhesion amount. The graph on the third top of the left side in FIG. 12 is an example of a measurement of the toner adhesion amount (e.g., the image density) of the toner image pattern 320*r* situated at the rear part of the intermediate transfer belt 10 in the main scanning direction illustrated in FIG. 6. The toner adhesion amount sensor 310R generates a toner adhesion amount detection signal 514R that indicates the toner adhesion amount.

The controller 500 calculates an average of the toner adhesion amount at each of the front part, the center part, and the front part of the intermediate transfer belt 10 in the main scanning direction based on the fluctuation of the toner adhesion amount detected at each of the front part, the center part, and the rear part. Concretely, the controller 500 calculates the average toner adhesion amounts 515F, 515C, and 515R based on the toner adhesion amount detection signals 514F, 514C, and 514R detected by the toner adhesion amount sensors 310F, 310C, and 310R, respectively. The graph in the left side of FIG. 12 illustrates the average toner adhesion amounts 515F, 515C, and 515R calculated based on the detected toner adhesion amount detection signals 514F, 514C, and 514R.

Each of the average toner adhesion amounts 515F, 515C, and 515R in the main scanning direction of the intermediate transfer belt 10 is identical ideally. However, in reality, the average toner adhesion amounts 515F, 515C, and 515R are different. If the average toner adhesion amounts 515F, 515C, and 515R in the main scanning direction of the intermediate transfer belt 10 are different, effect of the difference between the average toner adhesion amounts 515F, 515C, and 515R on the fluctuation (e.g., the amplitude) of the toner adhesion amount is considered.

Therefore, the controller 500 calculates the fluctuation rate [%] of the toner adhesion amount illustrated in three graphs located in a center part of FIG. 12 horizontally. Fluctuation in the sub-scanning direction of the toner adhesion amount at each of the front part, the center part, and the rear part in the main scanning direction of the intermediate transfer belt 10 is converted into a fluctuation rate from each of the average toner adhesion amounts 515F, 515C, and 515R. Thus, the controller 500 improves correction accuracy.

The controller 500 may measure multiple times a waveform in a plurality of cycles of each of the toner adhesion amount detection signals 514F, 514C, and 514R detected by the toner adhesion amount sensors 310F, 310C, and 310R, respectively. The controller 500 may average the measured waveform as the toner adhesion amount detection signals 514F, 514C, and 514R. The controller 500 may calculate fluctuation rates 516F, 516C, and 516R of the toner adhesion amount based on the average waveforms of the toner adhesion amount detection signals 514F, 514C, and 514R, respectively.

The controller 500 calculates the average waveforms of the fluctuation rates 516F, 516C, and 516R of the toner adhesion amount based on the calculated fluctuation rates 516F, 516C, and 516R of the toner adhesion amount at the front part, the center part, and the rear part of the intermediate transfer belt 10 in the main scanning direction, respectively, as illustrated in the graph on the top of the right side in FIG. 12. The bottom graph of the right side in FIG. 12 illustrates an example of a measurement of the rotational position signal of each of the photoconductors 40Y, 40M, 40C, and 40K detected by the photointerrupters 71 when the toner image patterns 320 illustrated in FIG. 6 are formed. An interval between a time T1 and a time T2 defines a cycle Ts of each of the photoconductors 40Y, 40M, 40C, and 40K.

The average waveforms of the fluctuation rates 516F, 516C, and 516R of the toner adhesion amount are fitted in a sine wave based on the rotational position detection signal of each of the photoconductors 40Y, 40M, 40C, and 40K. A quadrature detection is used for fitting of the sine wave according to the second illustrative embodiment. The controller 500 calculates an appropriate amplitude and an appropriate phase (A(ave), θ(ave)) to be corrected using the developing bias control table and the charging bias control table based on an amplitude and a phase obtained by quadrature detection.

The controller 500 prepares control data (e.g., a control table) to offset the fluctuation of the average toner adhesion amounts 515F, 515C, and 515R indicated by a correction signal defined by the calculated amplitude and phase (A(ave), θ(ave)), as illustrated in FIG. 10.

The controller 500 calculates the phase of each of the front part, the center part, and the rear part of the intermediate transfer belt 10 in the main scanning direction from the fluctuation of the toner adhesion amount or the fluctuation rate of the toner adhesion amount. If the difference between the calculated phases is equal to or more than a predetermined value, the fluctuation data whose phase is different from others may be omitted from calculation of the average waveform. Omitting such abnormal data improves correction accuracy.

For example, if the difference between the calculated phases results from the fluctuation of the toner adhesion amount, the controller 500 measures the waveform for five cycles five times for each of the toner adhesion amount detection signals 514F, 514C, and 514R generated by the toner adhesion amount sensors 310F, 310C, and 310R. The controller 500 compares a first waveform measured firstly as a reference waveform with a second waveform measured secondly for each of the toner adhesion amount detection signals 514F, 514C, and 514R. If the first waveform and the second waveform exhibit a phase difference that is greater than a predetermined threshold, the controller 500 excludes the first waveform and the second waveform from calculation of the average waveform. The predetermined threshold of the phase difference varies depending on an image formation system. The predetermined threshold is determined by experiment. According to the second illustrative embodiment, a predetermined threshold θ is not greater than 40 degrees. The number of measurements is not limited to five times. Preferably, the number of measurements is more than twice. The reference waveform is not limited to the first waveform measured firstly. Any one of waveforms measured five times may be used as the reference waveform.

For example, if the difference between the calculated phases results from the fluctuation rate of the toner adhesion amount, the controller 500 measures the waveform for five cycles five times for each of the toner adhesion amount detection signals 514F, 514C, and 514R generated by the toner adhesion amount sensors 310F, 310C, and 310R. The controller 500 converts each of the toner adhesion amount detection signals 514F, 514C, and 514R into the fluctuation rate of the toner adhesion amount. The controller 500 compares a first converted waveform having the fluctuation rate of the toner adhesion amount obtained by conversion from a first measured waveform measured firstly as a reference waveform with a second converted waveform having the fluctuation rate of the toner adhesion amount obtained by conversion from a second measured waveform measured secondly. If the first converted waveform and the second converted waveform exhibit a phase is greater than a predetermined threshold, the controller 500 excludes the first converted waveform and the second converted waveform from the calculation of the average waveform. The predetermined threshold of the phase difference varies depending on the image formation system. The predetermined threshold is determined by experiment. According to the second illustrative embodiment, a predetermined threshold θ is not greater than 40 degrees. The number of measurements is not limited to five times. Preferably, the number of measurements is more than twice. The reference waveform is not limited to the first converted waveform having the fluctuation rate of the toner adhesion amount obtained by conversion from the first measured waveform measured firstly. Any one of waveforms having the fluctuation rate of the toner adhesion amount obtained by conversion from any one of the waveforms measured five times may be used as the reference waveform.

The example illustrated in FIG. 12 is an example of a measurement when the rotational position signal of each of the photoconductors 40Y, 40M, 40C, and 40K and the toner adhesion amount detection signals 514F, 514C, and 514R output from the toner adhesion amount sensors 310F, 310C, and 310R are measured in parallel. Alternatively, the rotational position signal of the developing roller of each of the developing devices 61Y, 61M, 61C, and 61K and the toner adhesion amount detection signals 514F, 514C, and 514R output from the toner adhesion amount sensors 310F, 310C, and 310R may be measured in parallel. Since two rotating bodies, that is, the photoconductor (e.g., the photoconductors 40Y, 40M, 40C, and 40K) and the developing roller are used according to the second illustrative embodiment, the controller 500 may calculate to prepare a modulation table defining the appropriate amplitude and the appropriate phase to be corrected for a rotation cycle of each of the photoconductor and the developing roller.

In the above description, the development bias is fluctuated cyclically. The charging bias may be fluctuated similarly. If the control table is the charging bias control table made of control data of the charging bias, the charging bias control table is applied taking into consideration the distance between the charging position where the charging devices 60Y, 60M, 60C, and 60K charge the photoconductors 40Y, 40M, 40C, and 40K, respectively, and the toner adhesion amount sensor 310.

At least one of a photoconductor (e.g., the photoconductors 40Y, 40M, 40C, and 40K) and a developing device (e.g., the developing devices 61Y, 61M, 61C, and 61K) may be detachably attached to the body 100 of the image forming apparatus 1 according to the second illustrative embodiment. This configuration of the second illustrative embodiment is equivalent to the configuration of the first illustrative embodiment described above. Thus, the image forming apparatus 1 facilitates maintenance. The photointerrupters 71 and 72 as the rotational position detector may be located inside the body 100. Thus, the photointerrupters 71 and 72 are not replaced with the photoconductor or the developing device, decreasing running costs.

The illustrative embodiments described above are examples and the various aspects of the present disclosure attain respective effects as follows.

Aspect A

The image forming apparatus 1 includes an image bearer that rotates in a predetermined direction of rotation such as the intermediate transfer belt 10; a toner image forming device such as the developing devices 61Y, 61M, 61C, and 61K configured to form a plurality of toner image patterns on the image bearer; a plurality of image density detectors such as the toner adhesion amount sensors 310 configured to detect a density of the toner image patterns formed on the image bearer by the toner image forming device; and a controller such as the controller 500 configured to determine an image forming condition used to form a toner image having a predetermined target density based on the detected density of the toner image patterns. The plurality of image density detectors is disposed opposite a plurality of positions, respectively, on the image bearer in a width direction (e.g., a main scanning direction) perpendicular to the direction of rotation of the image bearer. The controller causes the toner image forming device to form the toner image patterns having an identical density at the plurality of positions on the image bearer, respectively. The controller identifies multiple cyclic fluctuations of the density of the toner image patterns. The controller determines the image forming condition based on the multiple cyclic fluctuations of the density of the toner image patterns. The image forming condition decreases an amplitude caused by the multiple cyclic fluctuations of the density of the toner image patterns to cause the toner image forming device to form the toner image having the predetermined target density.

Accordingly, as described above in the illustrative embodiments, the controller determines the image forming condition to decrease each amplitude of the multiple cyclic fluctuations in the density of the toner image patterns with the identical density. The toner image patterns are detected by the plurality of image density detectors disposed at predetermined intervals opposite the plurality of positions on the image bearer in the width direction (e.g., the main scanning direction) perpendicular to the direction of rotation of the image bearer.

The controller causes the toner image forming device to form the toner image under the image forming condition determined as described above, suppressing the multiple cyclic fluctuations in a recording medium conveyance direction of the density of the toner image among the plurality of positions on the image bearer in the width direction of the image bearer that is perpendicular to the recording medium conveyance direction, as a whole.

Aspect B

In aspect A, the controller determines an amplitude and a phase of control data that changes the image forming condition cyclically so as to decrease the amplitude caused by the multiple cyclic fluctuations of the density of the toner image patterns detected by the multiple image density detectors.

Accordingly, as described above in the illustrative embodiments, the controller decreases the amplitude caused by the multiple cyclic fluctuations of the density of the toner image patterns detected by the multiple image density detectors. The image forming apparatus 1 decreases the multiple cyclic fluctuations of the density at the multiple positions on the image bearer in the width direction thereof.

Aspect C

In aspect B, the controller identifies the amplitude and the phase of each of the multiple cyclic fluctuations of the density detected by the multiple image density detectors, respectively. The controller plots points representing the identified amplitude and the identified phase on polar coordinates, for example, the identified amplitude as a radial coordinate value and the identified phase as an angular coordinate value on the polar coordinates. The controller calculates a center of a minimum covering circle covering the plotted points. The controller sets an amplitude of the calculated center as a fluctuation amplitude used to correct the image forming condition and sets a phase of the calculated center as a fluctuation phase used to correct the image forming condition.

Accordingly, as described above in the first illustrative embodiment, the center of the minimum covering circle on the polar coordinates defines a coordinate at which residual errors between the amplitude and the phase of each of the detected multiple cyclic fluctuations.

Therefore, the controller sets the amplitude and the phase of the center of the minimum covering circle as the fluctuation amplitude and the fluctuation phase used to correct the image forming condition, thus suppressing or minimizing the multiple cyclic fluctuations of the density at the multiple positions on the image bearer in the width direction thereof as a whole.

Aspect D

In aspect B, the controller identifies the amplitude and the phase of each of the multiple cyclic fluctuations of the density detected by the multiple image density detectors, respectively. The controller plots points representing the identified amplitude and the identified phase on polar coordinates, for example, the identified amplitude as a radial coordinate value and the identified phase as an angular coordinate value on the polar coordinates. The controller calculates a barycenter of the plotted points as a radial coordinate value and an angular coordinate value on the polar coordinates. The controller sets an amplitude of the calculated barycenter as the fluctuation amplitude used to correct the image forming condition and sets a phase of the calculated barycenter as the fluctuation phase used to correct the image forming condition.

Accordingly, as described above in the first illustrative embodiment, calculation of the barycenter on the polar coordinates based on the multiple cyclic fluctuations of the density is easier than calculation of the center of the minimum covering circle described in aspect C.

The residual error in aspect D is slightly greater than that the residual error in aspect C. However, a processing time to calculate the amplitude and the phase used to correct the image forming condition, that is, a time for adjustment to correct the image forming condition is shortened.

Coordinates of the barycenter are calculated as follows. Vectors P, Q, and R are vectors whose components are amplitudes and phases of the multiple cyclic fluctuations of the density detected. A vector S whose components are the fluctuation amplitude and the fluctuation phase used to correct the image forming condition is calculated by the following equation (5).

$$S=(P+Q+R)/3 \tag{5}$$

Aspect E

In any one of aspects A through D, the controller averages a waveform representing each of the multiple cyclic fluctuations detected by the multiple image density detectors, calculating an amplitude and a phase of the average waveform.

Accordingly, as described above in the illustrative embodiments, the controller improves accuracy of a control to decrease the above multiple cyclic fluctuations of the density as a whole.

Especially, in the aspect C or D that performs the calculation of the center of the minimum covering circle covering the plotted points representing the multiple cyclic fluctuations on the polar coordinates or the barycenter of the plotted points, averaging of each of the waveforms representing the multiple cyclic fluctuations of the density is equivalent to calculation of the amplitude and the phase of each of the waveforms.

Therefore, averaging of the waveforms attains a single quadrature detection and shortens a calculation time to calculate a target amplitude and a target phase used to correct the image formation condition.

Aspect F

In aspect E, the controller measures waveform representing the multiple cyclic fluctuations of the density detected by the multiple image density detectors for multiple times, respectively, The controller calculates a phase difference between one of the measured multiple waveforms and another one of the measured multiple waveforms. The controller excludes the another waveform that defines the phase difference not smaller than a predetermined threshold and averages the measured multiple waveforms.

Accordingly, as described above in the second illustrative embodiment, the controller improves accuracy of the waveform representing the multiple cyclic fluctuations of the density detected by the multiple image density detectors.

Additionally, the controller prevents adverse effect of a detection error of the image density detectors, faulty formation of the toner image patterns, and the like.

Aspect G

In any one of aspects A through D, the controller calculates an average of the waveforms representing the multiple cyclic fluctuations of the density detected by the multiple image density detectors, respectively, converts the waveforms into a plurality of waveforms having a plurality of fluctuation rates defined based on the average of the waveforms, respectively, and calculates a fluctuation amplitude and a fluctuation phase based on the plurality of fluctuation rates of the converted waveforms.

Accordingly, as described above in the second illustrative embodiment, the controller improves further the accuracy of the control to decrease the multiple cyclic fluctuations of the density as a whole even if the average of the waveforms representing the multiple cyclic fluctuations of the density detected by the multiple image density detectors varies depending on the multiple image density detectors. Because the above calculation decreases adverse effect caused by the difference of the average of the waveforms.

Aspect H

In aspect G, the controller averages the converted waveforms based on the plurality of fluctuation rates of the converted waveforms to calculate the fluctuation amplitude and the fluctuation phase.

Accordingly, as described above in the second illustrative embodiment, the controller improves further accuracy of the control to decrease the above multiple cyclic fluctuations of the density as a whole.

Aspect I

In aspect H, the controller measures multiple times the waveforms representing the multiple cyclic fluctuations and having the plurality of fluctuation rates times. The controller calculates a phase difference between one of the plurality of converted waveforms having the plurality of fluctuation rates, respectively, and another one of the plurality of converted waveforms. The controller excludes the another one of the waveforms that defines the phase difference not smaller than a predetermined threshold and averages the measured multiple waveforms.

Accordingly, as described above in the second illustrative embodiment, the controller improves accuracy of the waveform representing the multiple cyclic fluctuations of the density detected by the multiple image density detectors.

Additionally, the controller prevents adverse effect of a detection error of the image density detectors, faulty formation of the toner image patterns, and the like.

Aspect J

In any one of aspects A through I, the toner image forming device includes a latent image bearer such as the rotatable photoconductors 40Y, 40M, 40C, and 40K, the exposure unit 21 to form the latent image on the latent image bearer, a developing device, such as the developing devices 61Y, 61M, 61C, and 61K, including a developer bearer such as the developing roller 61Ka that is rotatable and develops the latent image on the latent image bearer into a toner image, and a rotational position detector such as the photointerrupters 71 and 72 to detect a rotational position of at least one of the latent image bearer and the developer bearer.

Accordingly, as described above in the illustrative embodiments, the toner image forming device suppresses the multiple cyclic fluctuations of the density caused by rotation of the latent image bearer or the developer bearer.

Aspect K

In aspect J, at least one of the latent image bearer and the developing device is removably attached to the body 100 of the image forming apparatus 1 and the rotational position detector is disposed inside the body 100.

Accordingly, as described above in the illustrative embodiments, the image forming apparatus 1 facilitates maintenance because at least one of the latent image bearer and the developer bearer is removably attached from the body 100.

The image forming apparatus 1 decreases running costs because the rotational position detector is disposed inside the body 100 and is not replaced with the latent image bearer and the developing device.

Aspect L

In aspect K, the controller updates the image forming condition when the image forming apparatus starts after the controller detects removal and attachment of at least one of the latent image bearer and the developing device.

As described above in the illustrative embodiments, when a rotating body such as the latent image bearer and the developer bearer of the developing device is removed and attached, an angle of engagement between the rotating body and a driving shaft mounted on the body 100 may change.

Additionally, when the rotating body such as the latent image bearer and the developer bearer of the developing device is replaced with new one, the image forming condition may change.

To address this circumstance, the controller updates the image forming condition automatically, thus decreasing the multiple cyclic fluctuation of the density.

Aspect M

In any one of aspects A through L, the plurality of toner image patterns formed on the plurality of positions on the image bearer that is disposed opposite the plurality of image density detectors is a plurality of solid patterns, respectively, with a high density in a detectable sensitivity range of the plurality of image density detectors.

Accordingly, as described above in the illustrative embodiments, the image forming apparatus 1 suppresses the multiple cyclic fluctuations of the density of the solid patterns having the high density, which are formed on the plurality of positions on the image bearer in the width direction perpendicular to the recording medium conveyance direction as a whole.

Aspect N

In any one of aspects A through L,

The plurality of toner image patterns formed on the plurality of positions on the image bearer, that is disposed opposite the plurality of image density detectors is a plurality of half-tone patterns, respectively, with a medium density in the detectable sensitivity range of the plurality of image density detectors.

Accordingly, as described above in the illustrative embodiments, the image forming apparatus 1 suppresses the multiple cyclic fluctuations of the density of the solid patterns having the high density, which are formed on the plurality of positions on the image bearer in the width direction perpendicular to the recording medium conveyance direction as a whole.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, and in an order different from the one described above.

What is claimed is:

1. An image forming apparatus, comprising:

an image bearer to rotate in a predetermined direction of rotation;

a toner image forming device to form a plurality of toner image patterns on the image bearer;

a plurality of image density detectors to detect a density of the toner image patterns formed on the image bearer, the plurality of image density detectors being disposed at predetermined intervals opposite a plurality of positions, respectively, on the image bearer in a width direction perpendicular to the direction of rotation of the image bearer; and circuitry to determine an image forming condition used to form a toner image having a predetermined target density based on the detected density of the toner image patterns, the circuitry causing the toner image forming device to form the toner image patterns having an identical density at the plurality of positions on the image bearer, identifying multiple cyclic fluctuations of the density of the toner image patterns, and adjusting the image forming condition based on the multiple cyclic fluctuations of the density of the toner image patterns to decrease an amplitude caused by the multiple cyclic fluctuations of the density of the toner image patterns, determining the amplitude and a phase of control data that changes the image forming condition cyclically so as to decrease the amplitude caused by the multiple cyclic fluctuations of the density of the toner image patterns, identifying the amplitude and the phase of each of the multiple cyclic fluctuations of the density of the toner image patterns, plotting points representing the identified amplitude and the identified phase on polar coordinates, calculating a center of a minimum covering circle covering the plotted points, and setting an amplitude of the calculated center as a fluctuation amplitude used to correct the image forming condition and setting a phase of the calculated center as a fluctuation phase used to correct the image forming condition.

2. The image forming apparatus according to claim 1, wherein the circuitry averages a plurality of waveforms representing the multiple cyclic fluctuations of the density of the toner image patterns, respectively, to calculate an amplitude and a phase of an average waveform.

3. The image forming apparatus according to claim 2, wherein the circuitry measures a waveform multiple times, calculates a phase difference between one of the measured waveforms and another one of the measured waveforms, excludes the another one of the measured waveforms that defines the phase difference not smaller than a predetermined threshold, and averages the measured waveforms.

4. The image forming apparatus according to claim 3, wherein the circuitry calculates an average of the measured waveforms representing the multiple cyclic fluctuations of the density of the toner image patterns, converts the measured waveforms into a plurality of waveforms having a plurality of fluctuation rates defined based on the average of the measured waveforms, respectively, and calculates the fluctuation amplitude and the fluctuation phase based on the plurality of fluctuation rates of the converted waveforms.

5. The image forming apparatus according to claim 4, wherein the circuitry averages the converted waveforms based on the plurality of fluctuation rates of the converted waveforms to calculate the fluctuation amplitude and the fluctuation phase.

6. The image forming apparatus according to claim 5, wherein the circuitry calculates a phase difference between one of the plurality of converted waveforms having the plurality of fluctuation rates, respectively, and another one of the plurality of converted waveforms, excludes the another one of the waveforms that defines the phase difference not smaller than the predetermined threshold, and averages the measured waveforms.

7. The image forming apparatus according to claim 1, wherein the toner image forming device includes:

a latent image bearer that is rotatable;

an exposure unit to form a latent image on the latent image bearer;

a developing device including a developer bearer that is rotatable and develops the latent image on the latent image bearer into the toner image; and a rotational position detector to detect a rotational position of at least one of the latent image bearer and the developer bearer.

8. The image forming apparatus according to claim 7, further comprising a body, wherein at least one of the latent image bearer and the developing device is removably attached to the body, and wherein the rotational position detector is disposed inside the body.

9. The image forming apparatus according to claim 8, wherein the circuitry updates the image forming condition when the image forming apparatus starts after the circuitry detects removal and attachment of the at least one of the latent image bearer and the developing device.

10. The image forming apparatus according to claim 1, wherein the plurality of toner image patterns is a plurality of solid patterns, respectively, having a high density in a detectable sensitivity range of the plurality of image density detectors.

11. The image forming apparatus according to claim 1, wherein the plurality of toner image patterns is a plurality of half-tone patterns, respectively, having a medium density in a detectable sensitivity range of the plurality of image density detectors.

12. An image forming apparatus, comprising:

an image bearer to rotate in a predetermined direction of rotation;

a toner image forming device to form a plurality of toner image patterns on the image bearer;

a plurality of image density detectors to detect a density of the toner image patterns formed on the image bearer, the plurality of image density detectors being disposed at predetermined intervals opposite a plurality of positions, respectively, on the image bearer in a width direction perpendicular to the direction of rotation of the image bearer; and circuitry to determine an image forming condition used to form a toner image having a predetermined target density based on the detected density of the toner image patterns, the circuitry causing the toner image forming device to form the toner image patterns having an identical density at the plurality of positions on the image bearer, identifying multiple cyclic fluctuations of the density of the toner image patterns, and adjusting the image forming condition based on the multiple cyclic fluctuations of the density of the toner image patterns to decrease an amplitude caused by the multiple cyclic fluctuations of the density of the toner image patterns, determining the amplitude and a phase of control data that changes the image forming condition cyclically so as to decrease the amplitude caused by the multiple cyclic fluctuations of the density of the toner image patterns, identifying the amplitude and the phase of each of the multiple cyclic fluctuations of the density of the toner image patterns, plotting points representing the identified amplitude and the identified phase on polar coordinates, calculating a barycenter of the plotted points, and setting an amplitude of the calculated barycenter as a fluctuation amplitude used to correct the image forming condition and setting a phase of the calculated barycenter as a fluctuation phase used to correct the image forming condition.

13. The image forming apparatus according to claim 12, wherein the circuitry averages a plurality of waveforms representing the multiple cyclic fluctuations of the density of the toner image patterns, respectively, to calculate an amplitude and a phase of an average waveform.

14. The image forming apparatus according to claim 13, wherein the circuitry measures a waveform multiple times, calculates a phase difference between one of the measured waveforms and another one of the measured waveforms, excludes the another one of the measured waveforms that defines the phase difference not smaller than a predetermined threshold, and averages the measured waveforms.

15. The image forming apparatus according to claim 14, wherein the circuitry calculates an average of the measured waveforms representing the multiple cyclic fluctuations of the density of the toner image patterns, converts the measured waveforms into a plurality of waveforms having a plurality of fluctuation rates defined based on the average of the measured waveforms, respectively, and calculates the fluctuation amplitude and the fluctuation phase based on the plurality of fluctuation rates of the converted waveforms.

16. The image forming apparatus according to claim 15, wherein the circuitry averages the converted waveforms based on the plurality of fluctuation rates of the converted waveforms to calculate the fluctuation amplitude and the fluctuation phase.

17. The image forming apparatus according to claim 16, wherein the circuitry calculates a phase difference between one of the plurality of converted waveforms having the plurality of fluctuation rates, respectively, and another one of the plurality of converted waveforms, excludes the another one of the waveforms that defines the phase difference not smaller than the predetermined threshold, and averages the measured waveforms.

18. The image forming apparatus according to claim 12, wherein the toner image forming device includes:

a latent image bearer that is rotatable;

an exposure unit to form a latent image on the latent image bearer;

a developing device including a developer bearer that is rotatable and develops the latent image on the latent image bearer into the toner image; and a rotational position detector to detect a rotational position of at least one of the latent image bearer and the developer bearer.

19. The image forming apparatus according to claim 18, further comprising a body, wherein at least one of the latent image bearer and the developing device is removably attached to the body, and wherein the rotational position detector is disposed inside the body.

20. The image forming apparatus according to claim 19, wherein the circuitry updates the image forming condition when the image forming apparatus starts after the circuitry detects removal and attachment of the at least one of the latent image bearer and the developing device.

21. The image forming apparatus according to claim 12, wherein the plurality of toner image patterns is a plurality of solid patterns, respectively, having a high density in a detectable sensitivity range of the plurality of image density detectors.

22. The image forming apparatus according to claim 12, wherein the plurality of toner image patterns is a plurality of half-tone patterns, respectively, having a medium density in a detectable sensitivity range of the plurality of image density detectors.

23. An image forming method comprising:

rotating an image bearer in a predetermined direction of rotation;

forming a plurality of toner image patterns on the image bearer;

detecting, by a plurality of image density detectors, a density of the toner image patterns formed on the image bearer, the plurality of image density detectors being disposed at predetermined intervals opposite a plurality of positions, respectively, on the image bearer in a width direction perpendicular to the direction of rotation of the image bearer;

determining an image forming condition used to form a toner image having a predetermined target density based on the detected density of the toner image patterns;

forming the toner image patterns having an identical density at the plurality of positions on the image bearer;

identifying multiple cyclic fluctuations of the density of the toner image patterns, and adjusting the image forming condition based on the multiple cyclic fluctuations of the density of the toner image patterns to decrease an amplitude caused by the multiple cyclic fluctuations of the density of the toner image patterns;

determining the amplitude and a phase of control data that changes the image forming condition cyclically so as to decrease the amplitude caused by the multiple cyclic fluctuations of the density of the toner image patterns;

identifying the amplitude and the phase of each of the multiple cyclic fluctuations of the density of the toner image patterns;

plotting points representing the identified amplitude and the identified phase on polar coordinates;

calculating a barycenter of the plotted points; and setting an amplitude of the calculated barycenter as a fluctuation amplitude used to correct the image forming condition and setting a phase of the calculated barycenter as a fluctuation phase used to correct the image forming condition.

* * * * *